US007923653B2

(12) United States Patent
Ohsumi

(10) Patent No.: US 7,923,653 B2
(45) Date of Patent: Apr. 12, 2011

(54) KEY SWITCH SHEET AND KEY SWITCH MODULE

(75) Inventor: Yoshimasa Ohsumi, Kyoto (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 54 days.

(21) Appl. No.: 12/402,176

(22) Filed: Mar. 11, 2009

(65) Prior Publication Data

US 2009/0242374 A1 Oct. 1, 2009

(30) Foreign Application Priority Data

Mar. 28, 2008 (JP) ..... 2008-085763

(51) Int. Cl.
*H01H 1/10* (2006.01)

(52) U.S. Cl. ..... 200/512

(58) Field of Classification Search ..... 200/406, 200/314, 317, 315, 512–517, 5 A, 341–345
See application file for complete search history.

(56) References Cited

U.S. PATENT DOCUMENTS 6,593,537 B2 * 7/2003 Teruyama et al. ..... 200/515
6,595,653 B2 * 7/2003 Saito et al. ..... 362/84
7,399,937 B2 * 7/2008 Nishimura ..... 200/314

FOREIGN PATENT DOCUMENTS

JP 2004-055389 A 2/2004
JP 2007-287347 A 11/2007

* cited by examiner

*Primary Examiner* — Edwin A. Leon
(74) *Attorney, Agent, or Firm* — Osha Liang LLP

(57) ABSTRACT

A key switch sheet has a pressure sensitive adhesive layer for holding a contact spring by adhering to an apex portion of a dome-shaped contact spring at a back surface of a base material sheet. A thickness of the pressure sensitive adhesive layer at a region to be made to adhere to the apex portion of the contact spring is thicker than a thickness of the pressure sensitive adhesive layer at a peripheral region and thicker than or equal to a thickness of the pressure sensitive adhesive layer at a region where the base material sheet is made to adhere to a substrate.

23 Claims, 19 Drawing Sheets

KEY SWITCH SHEET AND KEY SWITCH MODULE

BACKGROUND OF THE INVENTION

1. Technical Field

The present invention relates to a key switch sheet and a key switch module. Specifically, the present invention relates to a key switch module substrate used in a key switch used by being incorporated in a mobile telephone, or the like; a key switch module having a key top arranged on the key switch module substrate; and a key switch sheet for fixing a contact spring of the key switch module substrate.

2. Related Art

In mobile telephones and the like, a key switch having a structure in which a key is pushed with a finger thereby deforming a contact spring underneath, conducting electrode portions by the contact spring and turning ON the switch is used. In such a key switch, a raised dome-shaped contact spring is arranged on a second contact portion formed to surround a first contact portion, the first contact portion is covered by the contact spring while being spaced apart from the first contact portion, and the front surface side of the contact spring is covered with a contact spring fixing sheet. In the key switch, the contact spring deforms when the key is pushed with the finger thereby contacting the first contact portion, so that the first contact portion and the second contact portion are electrically conducted by way of the contact spring thereby turning ON the relevant switch. When the finger is released from the key, the contact spring elastically returns to be spaced apart from the first contact portion, and the switch returns to a OFF state.

In such a key switch, the click feeling of when the key is pushed with the finger becomes an important issue since the stroke of the key is short, and various methods for improving the click feeling have been proposed.

For instance, in a key switch module disclosed in FIG. 1 of Japanese Unexamined Patent Publication No. 2004-55389 (Patent Document 1), an apex portion of the contact spring is fixed to the back surface of a fixing sheet, and a resin material is stacked and solidified in one layer or a plurality of layers at the front surface of the fixing sheet at a position corresponding to the apex portion of the contact spring to thereby form a resin dimple (projecting portion) at the front surface of the fixing sheet (see claim 3 of Patent Document 1). A satisfactory click feeling is obtained by pushing such a resin dimple with a pushing portion (pusher) arranged on the key, and deforming the contact spring with the resin dimple.

However, in the structure of Patent Document 1, the resin dimple is formed by adding the resin material to the front surface of the fixing sheet fixed with the contact spring, and thus processing of the fixing sheet is difficult. The cost of the fixing sheet greatly rises even if the resin dimple is processed in the fixing sheet. Furthermore, although such a key switch module desirably has a thin thickness so as to be incorporated in the mobile telephone, or the like, the thickness of the key switch increases by the thickness of the resin dimple compared to the conventional thickness since the resin dimple is arranged. Moreover, in the key switch module fabricated in such a manner, a problem in that the resin dimple may drop arises, where the cost further increases if measures are taken to prevent the resin dimple from dropping.

In some key switch modules, a flexible light guide sheet is sandwiched between the fixing sheet and the key, and the light of the light source is introduced into the light guide sheet. In such a key switch module, the light guided through a light guide plate exits from the front surface of the light guide plate by being diffused with a diffusion pattern on the back surface of the light guide plate, where the entire arrayed keys are illuminated from the rear surface side by the light leaked out from the front surface of the light guide plate. However, in the key switch module as disclosed in Patent Document 1, if a light guide sheet made from soft resin is sandwiched between the fixing sheet and the key, the resin dimple is buried in the light guide sheet when the key is pushed, and consequently, the stroke of the key becomes long and the effect of improving the click feeling significantly lowers.

Another key switch module is as disclosed in FIG. 3 of Japanese Unexamined Patent Publication No. 2007-287347 (Patent Document 2). In such a key switch module, the projecting surface side of the contact spring is covered with the fixing sheet and the apex portion of the contact spring is made to adhere to the back surface of the fixing sheet, a projection made from a flexible elastic body is arranged on the front surface of the fixing sheet so as to face the apex portion of the contact spring, and a sheet-like operation member is arranged on the front surface side of the fixing sheet with the projection in between.

The key switch module described in Patent Document 2 satisfies both absorption of manufacturing error in positional relationship between the operation member and the contact spring in a operating direction of the contact spring and thinning in the operating direction of the contact spring by arranging the elastic body between the fixing sheet and the sheet-like operation member, but is not aimed to improve the click feeling.

Even if the elastic body of Patent Document 2 has an effect of improving the click feeling, the elastic body is in the same arrangement as the resin dimple of Patent Document 1 in being arranged at the front surface of the fixing sheet on the side opposite to the contact spring by way of the fixing sheet. Therefore, the key switch module can be thinned compared to when a clearance is formed between the fixing sheet and the operation member as described in Patent Document 2, but the thickness of the key switch module is increased compared to when the elastic body and the clearance are not provided. Furthermore, the cost of the key switch module becomes high since an extra member, that is the elastic body, is required.

In the key switch module of Patent Document 2 as well, the click feeling greatly lowers if the light guide sheet is sandwiched between the fixing sheet and the operation member, similar to Patent Document 1

SUMMARY

The present invention has been devised to solve the problems described above, and an object thereof is to improve the click feeling of the key switch without adding a new component or a new mechanism, so that the click feeling of the key switch is improved while enhancing thinning and manufacturing property of the key switch and lowering the cost.

In accordance with one aspect of the present invention, a first key switch sheet according to the present invention relates to a key switch sheet having a pressure sensitive adhesive layer for holding a contact spring by adhering to an apex portion of a dome-shaped contact spring at a back surface of a base material sheet; wherein a thickness of the pressure sensitive adhesive layer at a region to be made to adhere to the apex portion of the contact spring is thicker than a thickness of the pressure sensitive adhesive layer at a peripheral region.

In the first key switch sheet of the present invention, the thickness of the pressure sensitive adhesive layer at the region to be made to adhere to the apex portion of the contact spring is thicker than the thickness of the pressure sensitive adhesive at the peripheral region, and thus the pressure sensitive adhesive layer projects out in a projected-form and serves as a projecting portion in the region to be made to adhere to the apex portion of the contact spring. The first key switch sheet has the apex portion of the contact spring adhered to the portion (pressure sensitive adhesive layer) projected out in a projected-form at the back surface, and is superimposed and arranged on the substrate formed with the fixed contact forming a pair, thereby forming the key switch module substrate, or the like. When the contact spring is pushed from above in this state, the contact spring is pushed at the apex portion by the projecting portion (hereinafter simply referred to as a projecting portion) formed by the pressure sensitive adhesive layer, whereby the click feeling in time of switch operation improves. Furthermore, since the projecting portion is on the back surface side of the base material sheet and directly contacts the contact spring, the force the projecting portion pushes the contact spring is less likely to be buffered by the elasticity of the base material sheet as when the projecting portion is formed on the front surface side of the base material sheet, and satisfactory click feeling can be obtained.

Even if the light guide sheet for illuminating the key top is superimposed and arranged on the front surface side of the first key switch sheet, the projecting portion will not be buried in the light guide sheet as when the projecting portion is arranged on the front surface side of the base material sheet, and thus the effect of improving the click feeling does not lower even if the light guide sheet is superimposed.

According to the first key switch sheet of the present invention, the projecting portion for pushing the contact spring is formed using the pressure sensitive adhesive layer (or part of the pressure sensitive adhesive) formed at the back surface of the base material sheet from the prior art, and thus an additional component is not required to improve the click feeling in time of switch operation. As a result, the thickness of the key switch module substrate and the key switch module does not become thicker even if the click feeling is improved, the key switch module substrate and the key switch module can be thinned, the manufacturing step of the key switch module substrate, and the like does not increase, and the cost does not rise. In addition, the projecting portion barely has the possibility of dropping since the projecting portion is a pressure sensitive adhesive layer.

In one embodiment of the first key switch sheet according to the present invention, the apex portion of the contact spring is made to adhere to the pressure sensitive adhesive layer for holding the contact spring to hold the contact spring. According to such an embodiment, the key switch module substrate is easy to handle in assembly since the contact spring is attached to the key switch sheet in advance. In particular, when a plurality of contact springs are used, the task of attaching the contact spring to the pressure sensitive adhesive layer one by one is omitted, and the assembly of the key switch module substrate is facilitated.

In another embodiment of the first key switch sheet according to the present invention, the pressure sensitive adhesive layer does not exit at the peripheral region. According to such an embodiment, the outer peripheral portion of the apex portion of the contact spring does not adhere to the base material sheet by the pressure sensitive adhesive, and thus the outer peripheral portion of the contact spring does not stick to the base material sheet thereby inhibiting deformation, and the click feeling in time of switch operation becomes more satisfactory.

In still another embodiment of the first key switch sheet according to the present invention, the pressure sensitive adhesive layer thicker than the thickness of the pressure sensitive adhesive layer at the peripheral region is formed at a region further on the outer side than the peripheral region. According to such an embodiment, the first key switch sheet can be made to adhere to the substrate arranged with the fixed contact by the pressure sensitive adhesive layer formed at the region on the outer side of the peripheral region.

In another embodiment of the first key switch sheet according to the present invention, the pressure sensitive adhesive layer does not exist at the peripheral region. According to such an embodiment, the outer peripheral portion of the apex portion of the contact spring does not adhere to the base material sheet by the pressure sensitive adhesive, and thus the outer peripheral portion of the contact spring does not stick to the base material sheet thereby inhibiting deformation, and the click feeling in time of switch operation becomes more satisfactory.

In yet another embodiment of the first key switch sheet according to the present invention, the pressure sensitive adhesive layer formed at the back surface of the base material sheet is formed by applying a pressure sensitive adhesive to the back surface of the base material sheet using screen printing method, gravure printing method, or roll coater method. According to such an embodiment, the pressure sensitive adhesive layer can be formed easily and inexpensively by applying the pressure sensitive adhesive through a general printing method.

In yet another embodiment of the first key switch sheet according to the present invention, the thickness of the pressure sensitive adhesive layer formed at the region to be made to adhere to the apex portion of the contact spring is preferably greater than or equal to 0.1 mm and smaller than or equal to 0.2 mm. The click feeling degrades if the thickness of the pressure sensitive adhesive layer is thinner than 0.1 mm, and the thinning of the key switch module substrate, and the like is inhibited if thicker than 0.2 mm.

In yet another embodiment of the first key switch sheet according to the present invention, a diameter of the region to be made to adhere to the apex portion of the contact spring is preferably smaller than or equal to 0.5 times a diameter of the contact spring. The click feeling degrades if the diameter of the region to be made to adhere to the apex portion of the contact spring is greater than 0.5 times the diameter of the contact spring.

In accordance with another aspect of the present invention, a key switch module substrate according to the present invention relates to a key switch module substrate in which an apex portion of a dome-shaped contact spring is made to adhere to a back surface of a base material sheet by a pressure sensitive adhesive or an adhesive, the back surface of the base material sheet is made to adhere to a substrate formed with a first fixed contact and a second fixed contact, which are switched to a conduction state or an insulation state by the contact spring, by pressure sensitive adhesive or adhesive, and the contact spring is faced to the first fixed contact and the second fixed contact; wherein a thickness of the layer of the pressure sensitive adhesive or the adhesive at a region where the apex portion of the contact spring is made to adhere to the base material sheet is thicker than a thickness of the layer of the pressure sensitive adhesive or the adhesive at a peripheral region; and a thickness of the layer of the pressure sensitive adhesive or the adhesive at a region where the base material sheet is made to adhere to the substrate is thicker than a thickness of the layer of the pressure sensitive adhesive or the adhesive at the peripheral region.

In the key switch module substrate of the present invention, the thickness of the layer of the pressure sensitive adhesive or the adhesive at the region where the apex portion of the contact spring is made to adhere is thicker than the thickness of the layer of the pressure sensitive adhesive or the adhesive at the peripheral region, and thus the layer of the pressure sensitive adhesive or the adhesive projects out in a projected-form and serves as a projecting portion in the region where the apex portion of the contact spring is made to adhere. Therefore, when the portion of the contact spring is pushed from above, the contact spring is pushed by the projecting portion (hereinafter simply referred to as a projecting portion) formed by the layer of the pressure sensitive adhesive or the adhesive, whereby the click feeling in time of switch operation improves. Furthermore, since the projecting portion is arranged on the back surface side of the base material sheet and directly contacts the contact spring, the force the projecting portion pushes the contact spring is less likely to be buffered by the elasticity of the base material sheet as when the projecting portion is formed on the front surface side of the base material sheet, and satisfactory click feeling can be obtained.

Even if the light guide sheet for illuminating the key top is superimposed and arranged on the front surface side of the key switch module substrate, the projecting portion will not be buried in the light guide sheet as when the projecting portion is arranged on the front surface side of the base material sheet, and thus the effect of improving the click feeling does not lower even if the light guide sheet is superimposed.

Furthermore, according to the key switch module substrate of the present invention, the projecting portion for pushing the contact spring is formed using the pressure sensitive adhesive layer (or adhesive layer) formed at the back surface of the base material sheet from the prior art, and thus an additional component is not required to improve the click feeling in time of switch operation. As a result, the thickness of the key switch module substrate does not become thicker even if the click feeling is improved, the key switch module substrate can be thinned, the manufacturing step of the key switch module substrate does not increase, and the cost does not rise. In addition, the projecting portion barely has the possibility of dropping since the projecting portion is a layer of pressure sensitive adhesive or adhesive.

In one embodiment of the key switch module substrate according to the present invention, part of the pressure sensitive adhesive or the adhesive applied to the outer side of the peripheral region is made to adhere to an outer peripheral portion of the contact spring, and some or all of the remaining portions are made to adhere to the substrate. According to such an embodiment, part of the pressure sensitive adhesive or the adhesive adhered to the substrate is made to adhere to the outer peripheral portion of the contact spring, and thus the contact spring is less likely to shift and move or is less likely to rise, and the position of the contact spring stabilizes.

In another embodiment of the key switch module substrate according to the present invention, a key switch sheet is fabricated in which the contact spring is fixed to the base material sheet by making the apex portion of the contact spring to adhere to the back surface of the base material sheet by the pressure sensitive adhesive or the adhesive, and a back surface of the key switch sheet is made to adhere to the substrate by the pressure sensitive adhesive or the adhesive to sandwich the contact spring between the substrate and the base material sheet. According to such an embodiment, the contact spring can be easily installed on the substrate by sandwiching the contact spring between the substrate and the base material sheet by attaching the key switch sheet attached with the contact spring in advance to the substrate.

In still another embodiment of the key switch module substrate according to the present invention, the thickness of the pressure sensitive adhesive or the adhesive formed at the region to be made to adhere to the apex portion of the contact spring is preferably greater than or equal to 0.1 mm and smaller than or equal to 0.2 mm. The click feeling degrades if the thickness of the pressure sensitive adhesive layer is thinner than 0.1 mm, and the thinning of the key switch module substrate, and the like is inhibited if thicker than 0.2 mm.

In yet another embodiment of the key switch module substrate according to the present invention, a diameter of the region to be made to adhere to the apex portion of the contact spring is preferably smaller than or equal to 0.5 times a diameter of the contact spring. The click feeling degrades if the diameter of the region to be made to adhere to the apex portion of the contact spring is greater than 0.5 times the diameter of the contact spring.

In accordance with still another aspect of the present invention, a second key switch sheet according to the present invention relates to a key switch sheet having a pressure sensitive adhesive layer for holding a contact spring by adhering to an apex portion of the dome-shaped contact spring at a back surface of a base material sheet; wherein a region in which the pressure sensitive adhesive layer does not exist is formed at the periphery of the pressure sensitive adhesive layer formed at the region to be made to adhere to the apex portion of the contact spring, and the pressure sensitive adhesive layer is formed at a region further on the outer side of the region in which the pressure sensitive adhesive does not exist; and the pressure sensitive adhesive layer formed at the region to be made to adhere to the apex portion of the contact spring and the pressure sensitive adhesive layer formed at the region on the outer side of the region in which the pressure sensitive adhesive layer does not exist are of same material.

The second key switch sheet of the present invention has the same configuration as the first key switch sheet of the present invention, and thus has effects similar to the first key switch. In other words, according to the second key switch, the contact spring can be pushed with the projecting portion formed by the pressure sensitive adhesive layer, and satisfactory click feeling can be obtained in time of switch operation. Furthermore, the effect of improving the click feeling is less likely to lower even if the light guide sheet is superimposed on the front surface side of the second key switch sheet. Moreover, an additional component is not required to improve the click feeling in time of switch operation, and thus the thickness of the key switch module substrate and the key switch module does not become thicker, the key switch module substrate and the key switch module can be thinned, the manufacturing step of the key switch module substrate, and the like does not increase, and the cost does not rise. In addition, the projecting portion barely has the possibility of dropping since the projecting portion is a pressure sensitive adhesive layer.

In addition, the pressure sensitive adhesive layer does not exist at the periphery of the projecting portion in the second key switch sheet of the present invention, and thus the outer peripheral portion of the apex portion of the contact spring does not adhere to the base material sheet, the outer peripheral portion of the contact spring does not stick to the base material sheet thereby inhibiting deformation, and the click feeling in time of switch operation becomes more satisfactory. Furthermore, since the pressure sensitive adhesive is formed in the region further on the outer side of the region in which the pressure sensitive adhesive layer does not exist, the second key switch sheet can be made to adhere to the substrate arranged with the fixed contact by such a pressure sensitive adhesive layer. The pressure sensitive adhesive formed in the region to be made to adhere to the apex portion of the contact spring and the pressure sensitive adhesive formed in the region on the outer side of the region in which the pressure sensitive adhesive does not exist are of the same material, and thus the cost of the pressure sensitive adhesive layer is inexpensive, and the pressure sensitive adhesive layer on the inner side and the pressure sensitive adhesive layer on the outer side of the region in which the pressure sensitive adhesive layer does not exist can be formed in one step.

In one embodiment of the second key switch sheet according to the present invention, the apex portion of the contact spring is made to adhere to the pressure sensitive adhesive layer for holding the contact spring to hold the contact spring. According to such an embodiment, the key switch module substrate is easy to handle in assembly since the contact spring is attached to the key switch sheet in advance. In particular, when the plurality of contact springs are used, the task of attaching the contact spring to the pressure sensitive adhesive layer one by one is omitted, and the assembly of the key switch module substrate is facilitated.

In another embodiment of the second key switch sheet according to the present invention, the pressure sensitive adhesive layer formed at the back surface of the base material sheet has an even thickness regardless of the formed position. According to such an embodiment, the base material sheet lies along the front surface of the contact spring when the base material sheet is attached to the substrate from above the contact spring, and thus the key switch sheet holding the contact spring can be attached to the substrate more easily, and the contact spring can be more easily pushed.

In still another embodiment of the second key switch according to the present invention, a thickness of the pressure sensitive adhesive layer formed at the region to be made to adhere to the apex portion of the contact spring is thicker than a thickness of the pressure sensitive adhesive layer formed at the region on the outer side of the region in which the pressure sensitive adhesive does not exist. According to such an embodiment, the contact spring is more easily made to adhere since the projecting length of the pressure sensitive adhesive layer formed at the region to be made to adhere to the apex portion of the contact spring becomes long.

In the second key switch sheet according to the present invention, the thickness of the pressure sensitive adhesive layer formed at the region to be made to adhere to the apex portion of the contact spring is preferably greater than or equal to 0.1 mm and smaller than or equal to 0.2 mm. The click feeling degrades if the thickness of the pressure sensitive adhesive layer is thinner than 0.1 mm, and the thinning of the key switch module substrate, and the like is inhibited if thicker than 0.2 mm.

In the second key switch sheet according to the present invention, a diameter of the region to be made to adhere to the apex portion of the contact spring is preferably smaller than or equal to 0.5 times a diameter of the contact spring. The click feeling degrades if the diameter of the region to be made to adhere to the apex portion of the contact spring is greater than 0.5 times the diameter of the contact spring.

In yet another embodiment of the second key switch sheet according to the present invention, the pressure sensitive adhesive layer formed at the back surface of the base material sheet is a two-sided pressure sensitive adhesive tape having one pressure sensitive adhering surface adhered to the base material sheet. According to such an embodiment, the pressure sensitive adhesive layer can be easily formed by making one surface of the two-sided pressure sensitive adhesive tape to adhere to the base material sheet.

In yet another embodiment of the second key switch sheet according to the present invention, the base material sheet is a reflecting sheet having a surface reflectivity of greater than or equal to 70%. According to such an embodiment, if the light guide sheet is arranged on the front surface side of the key switch sheet, the light leaked from the back surface side of the light guide sheet is reflected by the base material sheet to re-enter the light guide sheet, thereby enhancing the usage efficiency of the light in the light guide sheet. The surface reflectivity of the base material sheet is preferably greater than or equal to 70% as the re-usage efficiency of the light leaked from the light guide sheet lowers if smaller than 70%.

In yet another embodiment of the second key switch sheet according to the present invention, the base material sheet is a light guide sheet for illuminating a key top. According to such an embodiment, the key top can be illuminated from the back surface side by introducing light to the base material sheet (light guide sheet). Furthermore, the key switch module can be thinned and the cost can be reduced compared to when the light guide sheet is separately arranged.

In accordance with yet another aspect of the present invention, a key switch module according to the present invention relates to a key switch module including the key switch module substrate of the present invention; and a key top arranged on a front surface side of the key switch module substrate; wherein the key top is arranged with, in correspondence to the position of the contact spring, a push-button for switch operating by pushing down the contact spring from the outside.

The key switch module according to the present invention has effects of the key switch module substrate of the present invention, and in particular, obtains satisfactory click feeling. Furthermore, the switch operation can be performed by pushing a push-button since the push-button of the key top is arranged on the front surface, and thus the key switch module excels in operability.

In one embodiment of the key switch module according to the present invention, a light guide sheet for illuminating the key top from a back surface side is arranged between the key top and the key switch module substrate. According to such an embodiment, the key top can be illuminated from the back surface side, and thus the push-button will not be mistakenly operated even when used in dark places. Moreover, the projecting portion will not be buried in the light guide sheet as when the projecting portion is arranged on the front surface side of the base material sheet, and thus the effect of improving the click feeling is less likely to lower even if the light guide sheet is superimposed.

In another embodiment of the key switch module according to the present invention, a pusher made of a pressure sensitive adhesive is arranged at a back surface of the push-button so as to project from the back surface, the pusher being adhered to a member facing a rear surface of the key top at a position corresponding to the apex portion of the contact spring. According to such an embodiment, the click feeling of the key switch module improves since the pusher is arranged on the push-button. The pusher for pushing the contact spring and the pressure adhesive layer for fixing the push-button are configured by the same member since the pusher is formed by the pressure sensitive adhesive, and thus the key switch module can be further thinned and the cost can be lowered.

The means for solving the problems in the present invention have features appropriately combining the above-described components, where the present invention encompasses great number of variations that can be contrived from the combination of such components.

BRIEF DESCRIPTION OF THE DRAWINGS

FIG. 8A shows the comparative example and FIG. 8B shows the first embodiment;

DETAILED DESCRIPTION

Hereinafter, preferred embodiments of the present invention will be described with reference to the drawings.

First Embodiment

Figure 1:
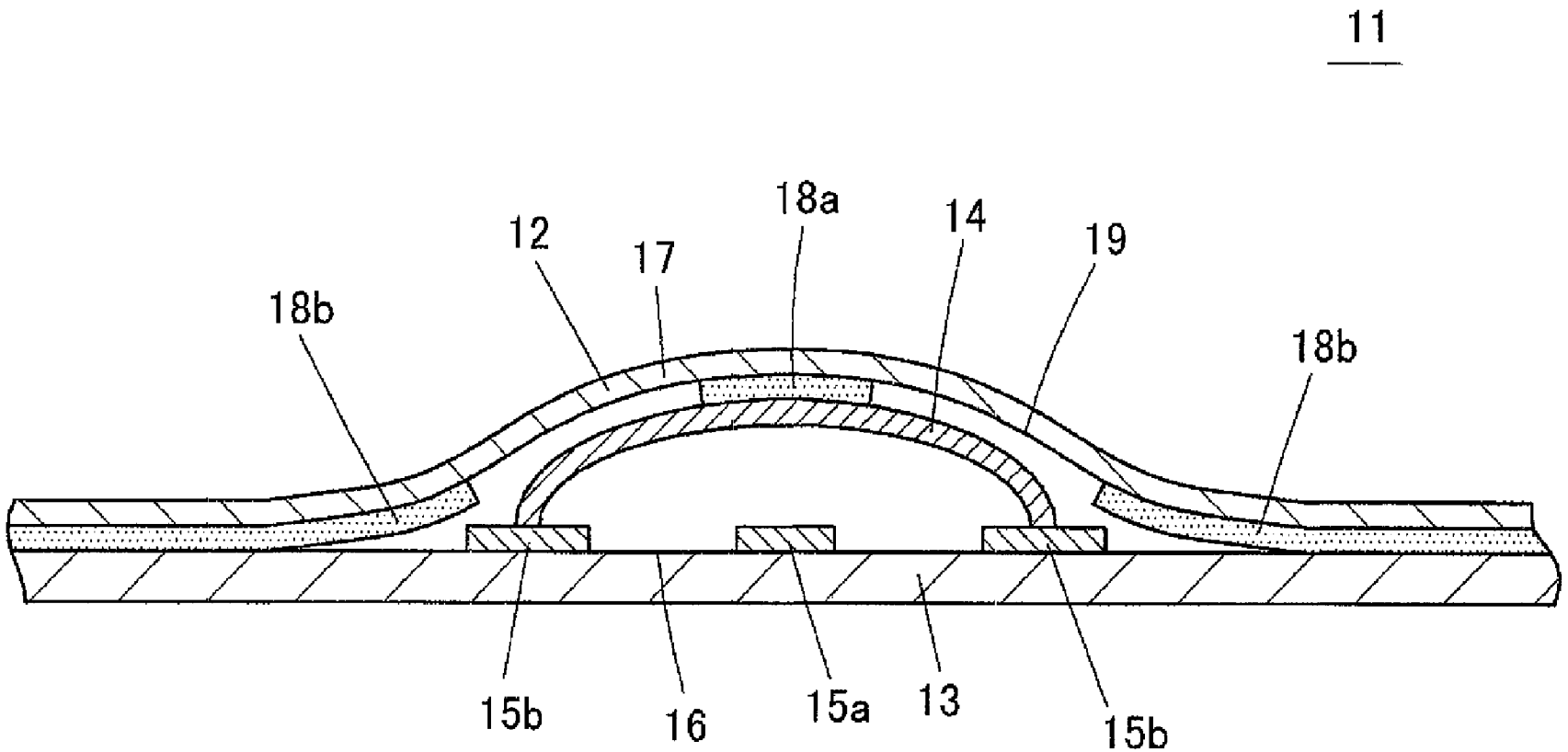
FIG. 1 is a cross-sectional view showing, in an enlarged manner, one part of a key switch module substrate according to a first embodiment of the present invention.
Figure 2:
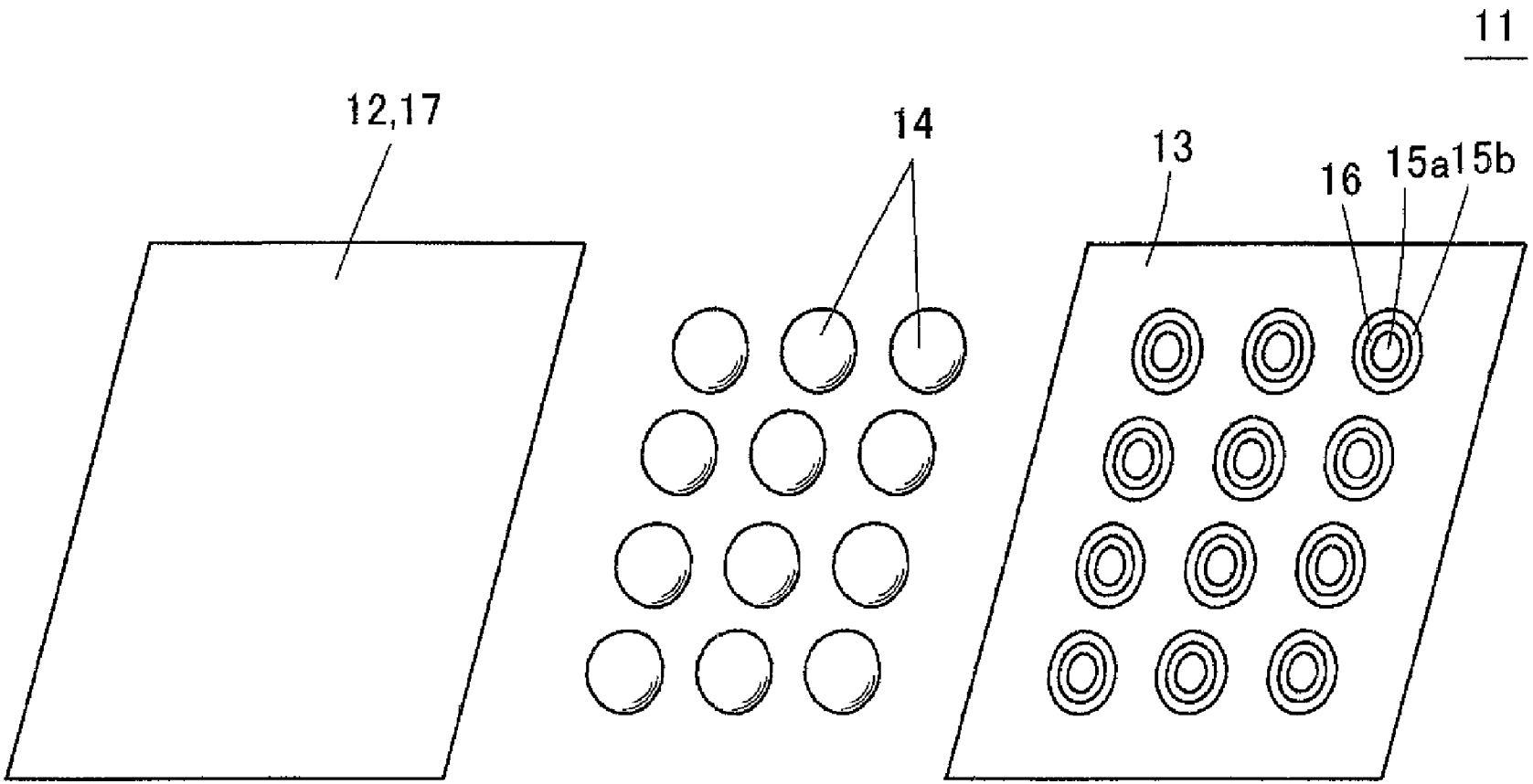
FIG. 2 is an exploded perspective view of the key switch module substrate of the first embodiment.
Figure 3:
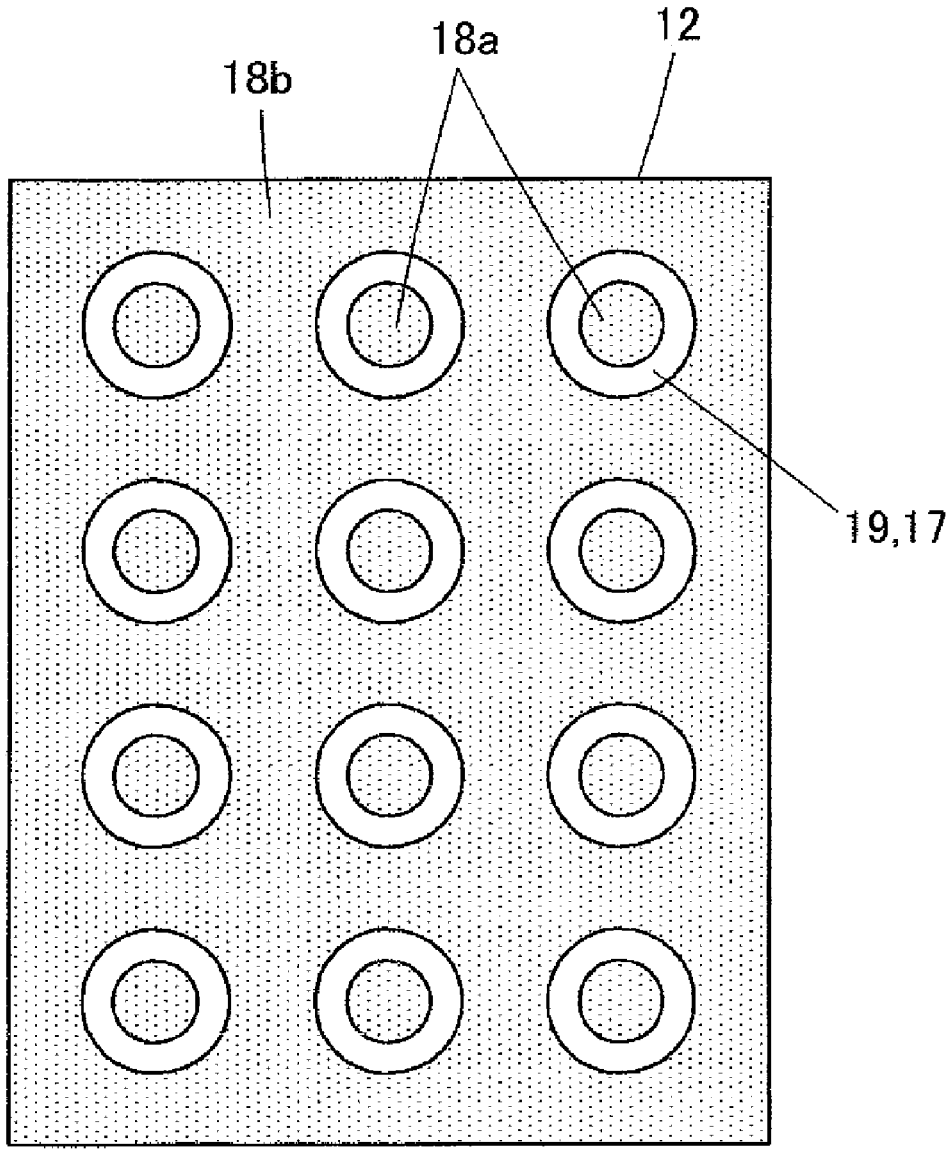
FIG. 3 is a rear view of a fixing sheet used in the key switch module substrate of the first embodiment.

A key switch module substrate according to a first embodiment of the present invention will be described below with reference to FIGS. 1 to 8. FIG. 1 is a cross-sectional view showing, in an enlarged manner, one part of a key switch module substrate 11 according to the first embodiment, FIG. 2 is an exploded perspective view of the key switch module substrate 11, and FIG. 3 is a rear view of a fixing sheet 12 (key switch sheet) used in the key switch module substrate 11.

The key switch module substrate 11 according to the first embodiment includes a printed wiring substrate 13 (substrate) including a flexible print substrate, a contact spring 14, and the fixing sheet 12. As shown in FIG. 2, a plurality of circular first contact portions 15*a* (first fixed contact) made from a conductive material are arrayed on the front surface of the printed wiring substrate 13, and a second contact portion 15*b* (second fixed contact) is annularly formed around each first contact portion 15*a* so as to surround the first contact portion 15*a*. An insulation gap 16 is provided between the first contact portion 15*a* and the second contact portion 15*b*. Although not shown, each first contact portion 15*a* is connected to an electrode pad, or the like arranged at an appropriate position through a wiring pattern formed on the back surface of the printed wiring substrate 13.

The contact spring 14 is formed to a raised dome-shape from a metal material having conductivity and elasticity, in particular, from a stainless material, where the back surface side is depressed to a bowl shape. The diameter of the contact spring 14 is larger than the inner diameter of the second contact portion 15*b* and smaller than the outer diameter of the second contact portion 15*b*.

The fixing sheet 12 is a pressure sensitive adhesive layer formed by applying a pressure sensitive adhesive to an even thickness on the back surface of a base material sheet 17 made from a thin and flexible resin sheet. As shown in FIG. 3, the pressure sensitive adhesive layer includes a circular projecting pressure sensitive adhesive layer (hereinafter referred to as a projecting portion 18*a*) for fixing an apex portion of the contact spring 14, and a pressure sensitive adhesive layer (hereinafter referred to as a substrate pressure sensitive adhesive layer 18*b*) for attaching the fixing sheet 12 to the printed wiring substrate 13, where an annular non-adhering surface 19 is formed between the projecting portion 18*a* and the substrate pressure sensitive adhesive layer 18*b*. The projecting portion 18*a* is arrayed at the same inter-center pitch as the first contact portion 15*a* of the printed wiring substrate 13 at the back surface of the fixing sheet 12 so as to be corresponded at one-to-one with the first contact portion 15*a*. The substrate pressure sensitive adhesive layer 18*b* is formed over substantially the entire region other than the regions of the projecting portion 18*a* and the non-adhering surface 19. The pressure sensitive adhesive is not applied to the non-adhering surface 19, and thus the non-adhering surface 19 is a region where the base material sheet 17 is exposed. The fixing sheet used is a fixing sheet in which acrylic pressure sensitive adhesive is applied to the back surface of the base material sheet, for example, N5610 (manufactured by Nitto Denko Corp.), N5610B (manufactured by Nitto Denko Corp.), or PETWH38 (A) PAT18LK2 (manufactured by Lintec Corp.), but a fixing sheet applied with pressure sensitive adhesive other than acrylic pressure sensitive adhesive may be used.

As shown in FIG. 1, the contact spring 14 is placed on the second contact portion 15*b* such that the lower surface of the outer peripheral part of the contact spring 14 contacts the second contact portion 15*b*, and covers the upper side of the first contact portion 15*a* in a dome-shape while being spaced apart from the first contact portion 15*a*. The fixing sheet 12 is superimposed on the printed wiring substrate 13 so as to cover the contact spring 14, and is attached to the front surface of the printed wiring substrate 13 by the substrate pressure sensitive adhesive layer 18*b*. The contact spring 14 has its apex portion adhered to the projecting portion 18*a*, and is fixed to the projecting portion 18*a* so as not to shift and move when pushed. The outer diameter of the projecting portion 18*a* (inner diameter of non-adhering surface 19) is sufficiently small compared to the diameter of the contact spring 14, and the outer diameter of the non-adhering surface 19 (inner diameter of the substrate pressure sensitive adhesive layer 18*b*) is greater than the diameter of the contact spring 14. Therefore, the projecting portion 18*a* does not adhere to the printed wiring substrate 13, and the substrate pressure sensitive adhesive layer 18*b* does not adhere to the contact spring 14.

In the key switch module substrate 11 having the structure of FIG. 1, the contact spring 14 elastically deforms thereby contacting the first contact portion 15*a* when the bulged portion of the contact spring 14 is pushed from above the fixing sheet 12, whereby the first contact portion 15*a* and the second contact portion 15*b* are conducted by way of the contact spring 14, and the switch is turned ON (closed state). The contact spring 14 elastically returns and separates from the first contact portion 15*a* when the force of pushing the contact spring 14 from above the fixing sheet 12 is removed, whereby the switch is turned OFF (opened state).

In the key switch module substrate 11, the projecting portion 18*a* has a function of positioning and fixing the contact spring 14 by adhering to the apex portion of the contact spring 14, and a function serving as a projecting portion of pushing the contact spring 14. That is, in the key switch module substrate 11, the contact spring 14 can be pushed by the projecting portion 18*a* arranged on the fixing sheet 12, and thus a click feeling when the key switch module substrate 11 is operated becomes satisfactory. Furthermore, the base material sheet 17 is not sandwiched between the projecting portion that pushes the contact spring 14 and the contact spring 14 as in Patent Document 1, and the projecting portion 18*a* directly contacts the apex portion of the contact spring 14, and thus the click feeling when pushed becomes satisfactory.

Figure 4A:
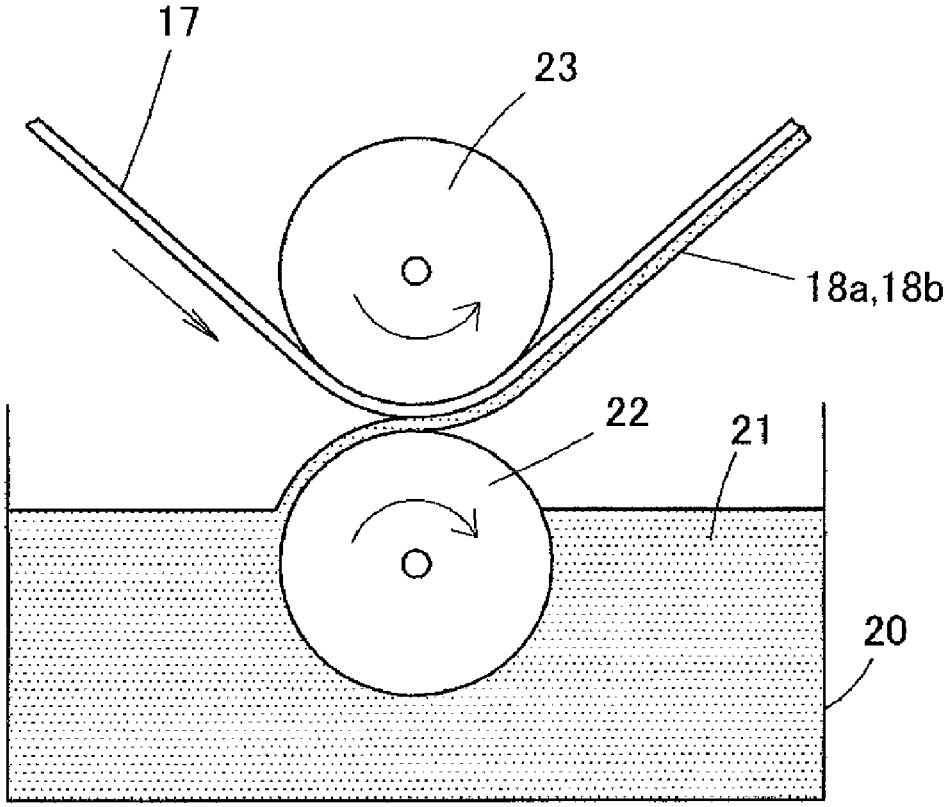
FIG. 4A is a schematic view showing a method of forming a projecting portion and a substrate pressure sensitive adhesive layer by applying a pressure sensitive adhesive on a base material sheet through a roll coater method.
Figure 4B:
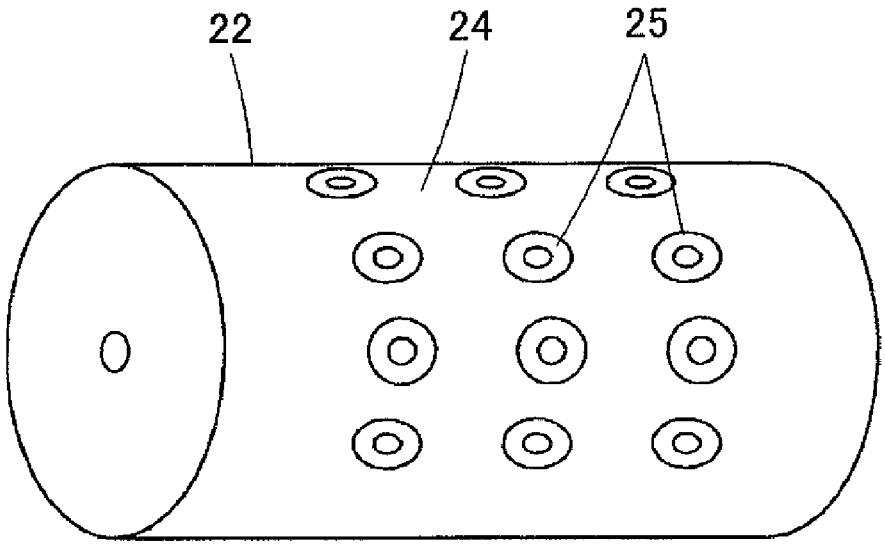
FIG. 4B is a perspective view of a transfer roller.

A manufacturing method of the key switch module substrate 11 will now be described. FIGS. 4A and 4B show a method of forming the projecting portion 18*a* and the substrate pressure sensitive adhesive layer 18*b* by applying a pressure sensitive adhesive on the base material sheet 17 through roll coater method. FIG. 4A schematically describes the roll coater method, where a pressure sensitive adhesive 21 is stored in a pressure sensitive adhesive bath 20, and the lower half of a transfer roller 22 is immersed in the pressure sensitive adhesive 21. A backup roller 23 faces the transfer roller 22, so that the base material sheet 17 passes through a gap between the transfer roller 22 and the backup roller 23. As shown in FIG. 4B, a transfer portion 24 and a non-transfer portion 25 are formed on an outer peripheral surface of the transfer roller 22. The transfer portion 24 is the portion of transferring the attached pressure sensitive adhesive 21 to the base material sheet 17 thereby forming the projecting portion 18*a* and the substrate pressure sensitive adhesive layer 18*b*, and the non-transfer portion 25 is the portion covered by a coating of a material that rejects the pressure sensitive adhesive 21 and prevents the adhesive from attaching thereby forming the non-adhering surface 19 between the projecting portion 18*a* and the substrate pressure sensitive adhesive layer 18*b*. Therefore, the base material sheet 17 is transferred with the projecting portion 18*a* and the substrate pressure sensitive adhesive layer 18*b* at a constant interval by passing through the gap between the transfer roller 22 and the backup roller 23, and then cut to an appropriate dimension to obtain the fixing sheet 12.

The pressure sensitive adhesive 21 may be transferred only at the transfer portion 24 by forming bumps on the surface of the transfer roller 22 through a gravure printing method, a relief printing method, and the like.

Figure 5:
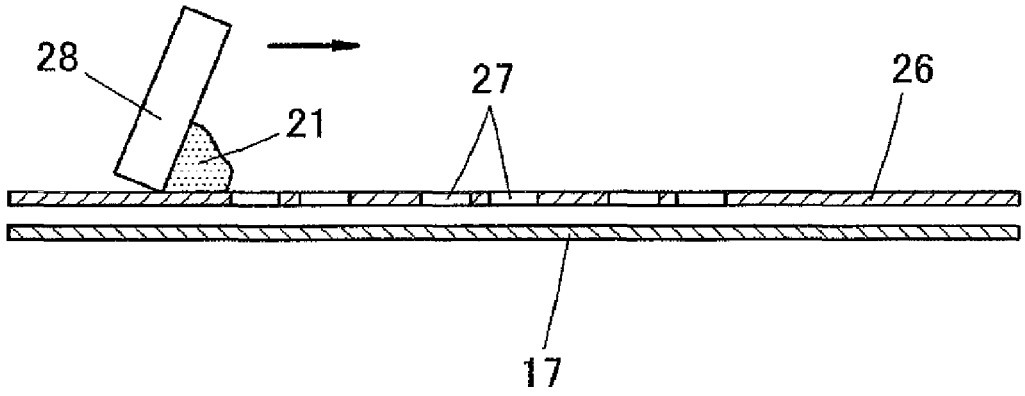
FIG. 5 is a schematic view showing a method of forming the projecting portion and the substrate pressure sensitive adhesive layer by applying a pressure sensitive adhesive on a base material sheet through a screen printing method or a stencil printing method.

FIG. 5 shows a method of forming the projecting portion 18*a* and the pressure sensitive adhesive layer 18*b* by applying the pressure sensitive adhesive on the base material sheet 17 through a screen printing method or a stencil printing method. A pattern opening 27 is opened in accordance with the pattern of the projecting portion 18*a* and the substrate pressure sensitive adhesive layer 18*b* in a stencil 26. The base material sheet 17 is arranged under the stencil 26, the pressure sensitive adhesive 21 is supplied onto the stencil 26, and the pressure sensitive adhesive 21 is scraped off along the upper surface of the stencil 26 by a squeegee 28, so that the pressure sensitive adhesive 21 in the pattern opening 27 is transferred onto the base material sheet 17 thereby forming the projecting portion 18*a* and the substrate pressure sensitive adhesive layer 18*b*.

Figure 6A:
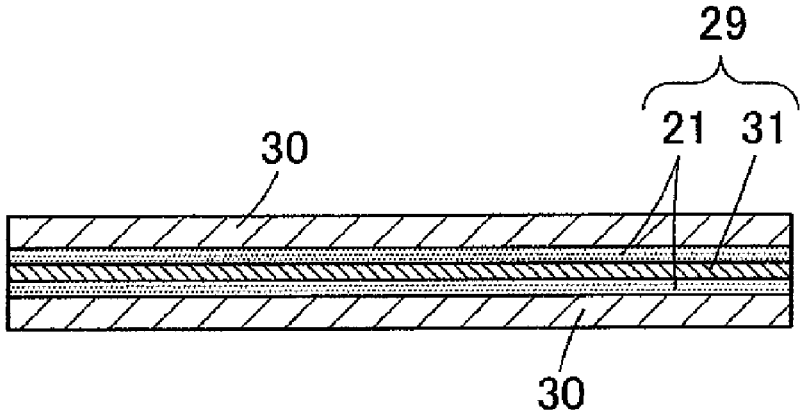
FIGS. 6A to 6D are schematic views showing a method of forming the projecting portion and the substrate pressure sensitive adhesive layer on the base material sheet using a two-sided pressure sensitive adhesive tape.
Figure 6B:
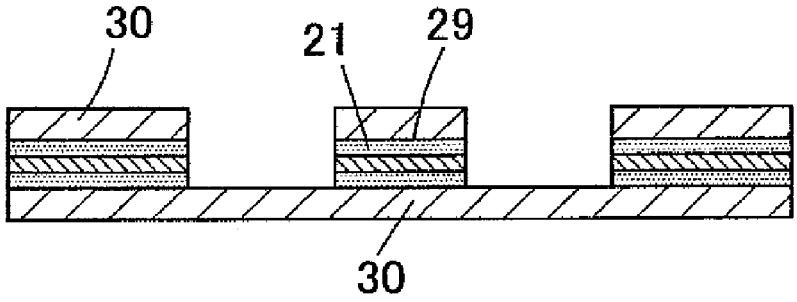
Figure 6C:
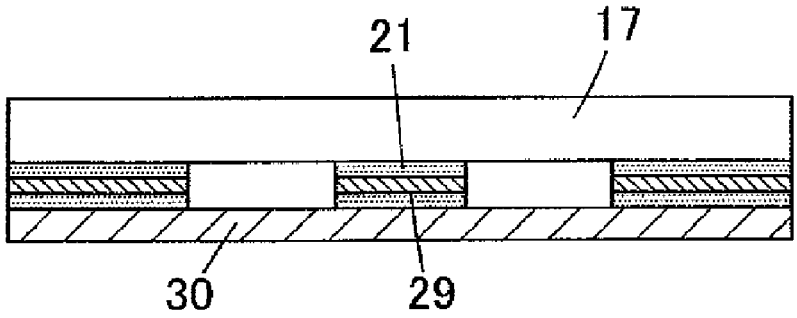
Figure 6D:
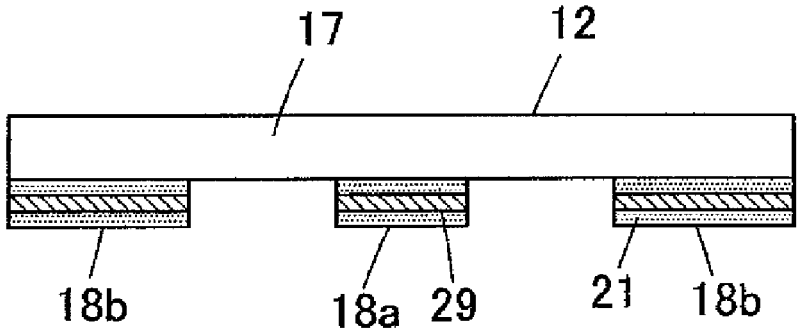

FIGS. 6A to 6D show a method of forming the projecting portion 18*a* and the substrate pressure sensitive adhesive layer 18*b* on the base material sheet 17 using a two-sided pressure sensitive adhesive tape 29. As shown in FIG. 6A, the two-sided pressure sensitive adhesive tape 29 having the pressure sensitive adhesive 21 applied on both sides of a core material 31 is attached with a released paper 30 on both surfaces. The two-sided pressure sensitive adhesive tape 29 is cut and partially removed in accordance with the pattern of the non-adhering surface 19, as shown in FIG. 6B. The released paper 30 on the cut side is then removed to expose one pressure sensitive adhesive 21, which is then attached to the lower surface of the base material sheet 17, as shown in FIG. 6C. The other released paper 30 is then stripped from the two-sided pressure sensitive adhesive tape 29, whereby the projecting portion 18*a* and the substrate pressure sensitive adhesive layer 18*b* are formed on the back surface of the base material sheet 17 by the two-sided pressure sensitive adhesive tape 29, as shown in FIG. 6D. In such a structure, the projecting portion 18*a* is less likely to be crushed, and the pushing force of the projecting portion 18*a* becomes larger since the core material 31 of the two-sided pressure sensitive adhesive tape 29 is contained inside the projecting portion 18*a* and the substrate pressure sensitive adhesive layer 18*b*.

As a method of fabricating the fixing sheet 12 by applying the pressure sensitive adhesive on the base material sheet 17, methods such as knife coater, die coater, gravure printing, relief printing, and the like may be used other than the above. The projecting portion 18*a* and the substrate pressure sensitive adhesive layer 18*b* are desirably made from the same material since the projecting portion 18*a* and the substrate pressure sensitive adhesive layer 18*b* can be formed with one application step if the pressure sensitive adhesive of the projecting portion 18*a* and the pressure sensitive adhesive of the substrate pressure sensitive adhesive layer 18*b* are of the same material.

Figure 7:
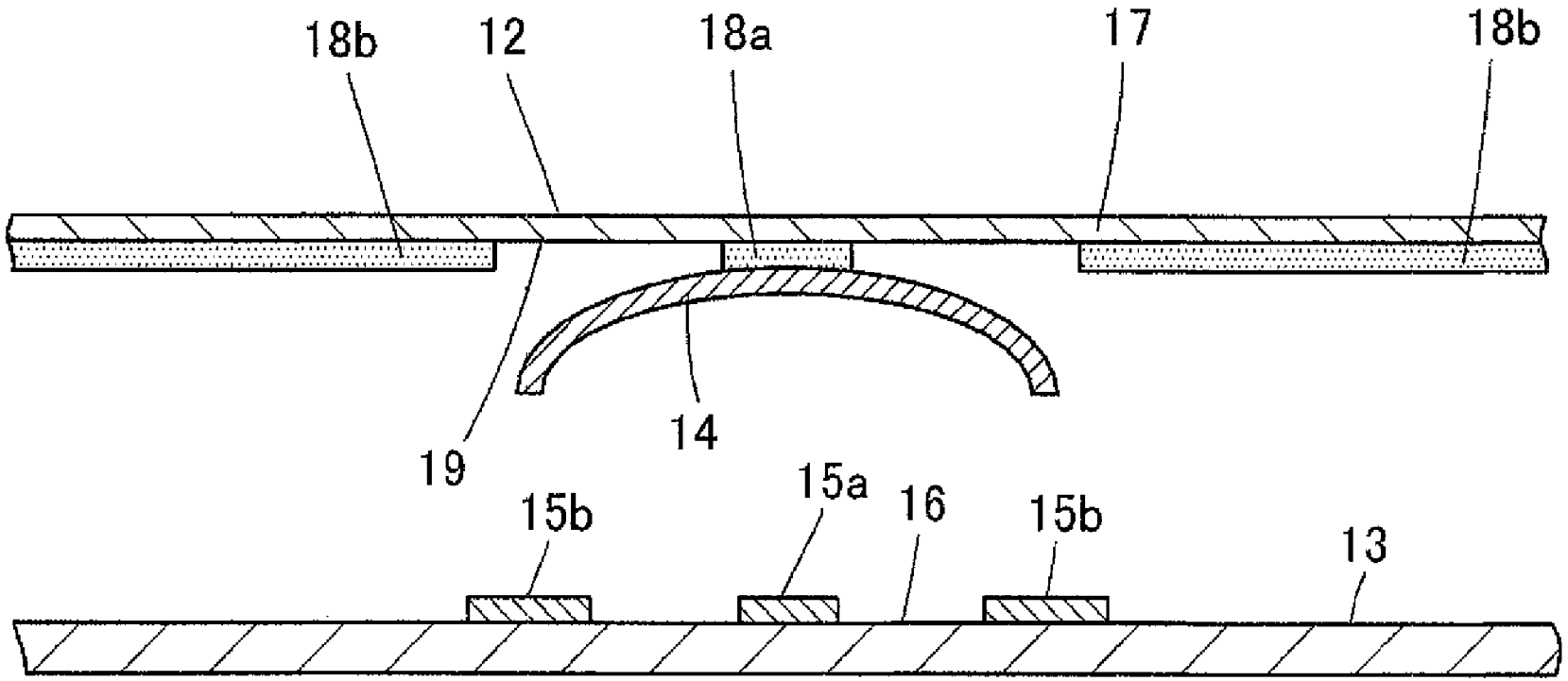
FIG. 7 is a cross-sectional view showing a state in which the apex portion of the contact spring is made to adhere to the projecting portion of the base material sheet.

After the fixing sheet 12 is fabricated through one of the above methods, the apex portion of the contact spring 14 is first made to adhere to each projecting portion 18*a* of the fixing sheet 12 to fix the contact spring 14 to the fixing sheet 12, as shown in FIG. 7.

The fixing sheet 12 is then superimposed on the printed wiring substrate 13 while aligning each contact spring 14 above each second contact portion 15*b*, and the substrate pressure sensitive adhesive layer 18*b* is made to adhere to the front surface of the printed wiring substrate 13 to integrate the fixing sheet 12 and the printed wiring substrate 13, thereby obtaining the key switch module substrate 11 as shown in FIG. 1.

In the key switch module substrate 11 according to the present embodiment, the pressure sensitive adhesive layer adhered to the apex portion of the contact spring 14 configures the projecting portion 18*a*, and thus the contact spring 14 is pushed by the projecting portion 18*a* when the portion of the contact spring 14 is pushed from above the fixing sheet 12, whereby the click feeling in time of switch operation improves. In other words, since the contact spring 14 is pushed with the projecting portion 18*a* smaller than the contact spring 14, the force of pushing the contact spring 14 is concentrated at the apex portion of the contact spring 14, whereby the contact spring 14 easily deforms and the click feeling improves. Furthermore, a more satisfactory click feeling can be obtained since the projecting portion 18*a* is arranged on the back surface side of the fixing sheet 12 and directly contacts the contact spring 14. That is, if a projecting portion 33 is arranged on the front surface side of the fixing sheet 12 as in FIG. 8A, the base material sheet 17 elastically deforms between the projecting portion 18*a* and the contact spring 14 when the projecting portion 33 is pushed, and the force of the projecting portion 18*a* pushing the contact spring 14 is buffered, but such a phenomenon is less likely to occur in the key switch module substrate 11 of the present embodiment.

Figure 8A:
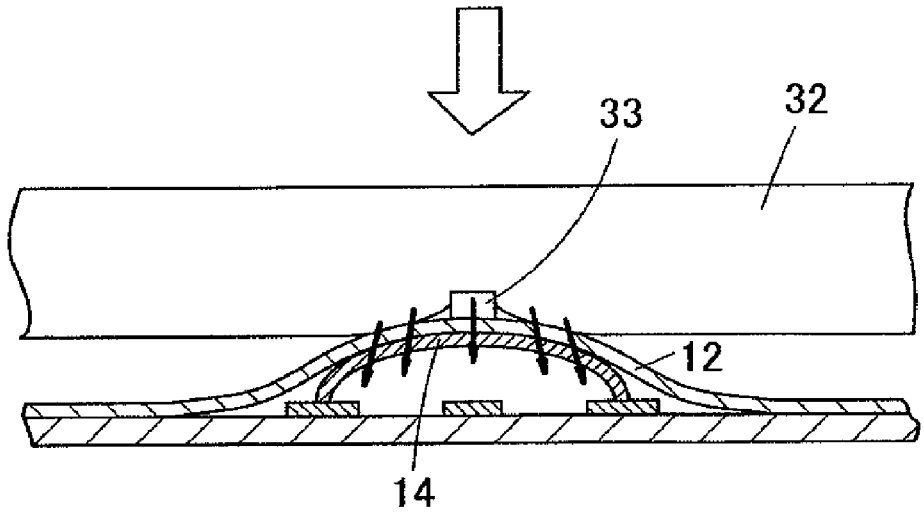
FIGS. 8A and 8B are views describing the effect of the key switch module substrate of the first embodiment in comparison with a comparative example, where
Figure 8B:
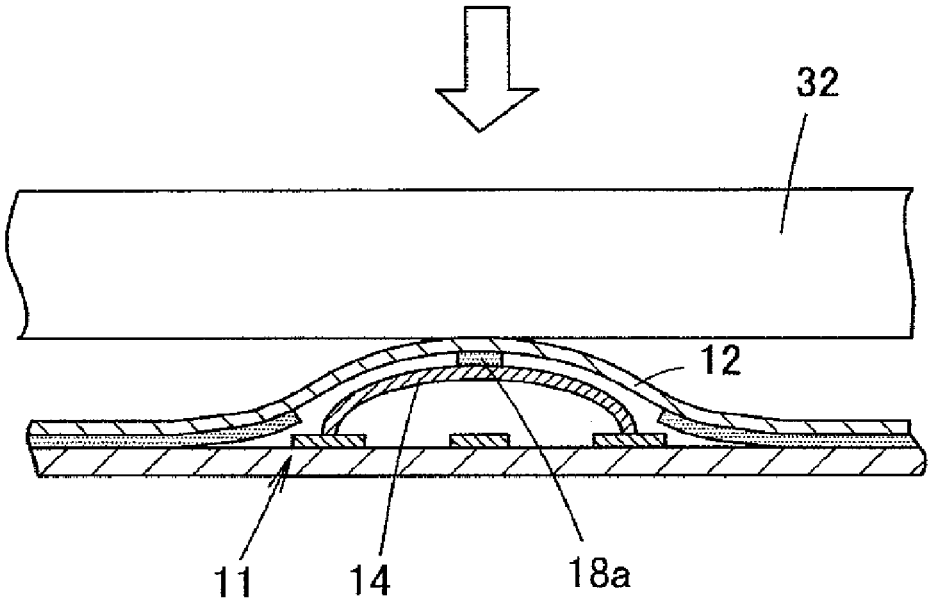

When a flexible light guide sheet 32 for key top illumination is superimposed and arranged on the front surface side of the fixing sheet 12 (see fourth embodiment), the front surface of the light guide sheet 32 may elastically deform by the projecting portion 33 or the projecting portion 33 may be buried in the light guide sheet 32 if the projecting portion 33 is arranged on the front surface side of the fixing sheet 12 as in FIG. 8A. Thus, the pushing force is absorbed, and the deformed light guide sheet 32 contacts the fixing sheet 12 thereby dispersing the pushing force, and as a result, the effect of improving the click feeling by the arrangement of the projecting portion 33 significantly lowers. As shown in FIG. 8B, in the case of the key switch module substrate 11 of the present embodiment, on the other hand, the projecting portion 18*a* will not be buried in the light guide sheet 32 and the light guide sheet 32 is less likely to deform, and thus the effect of improving the click feeling is less likely to lower.

Furthermore, according to the key switch module substrate 11 of the present embodiment, the projecting portion 18*a* is formed using the pressure sensitive adhesive layer formed at the back surface of the base material sheet 17 from the prior art, and thus an additional component is not required to improve the click feeling in time of switch operation. Therefore, the thickness of the key switch module substrate 11 does not become thicker even if the click feeling is improved, and the key switch module substrate 11 can be thinned. Moreover, the manufacturing step of the key switch module substrate 11 does not increase, and increase in cost is less likely to occur. In addition, an advantage in that the projecting portion barely has the possibility of dropping is obtained since the projecting portion 18*a* is a pressure sensitive adhesive layer.

Second Embodiment

Figure 9:
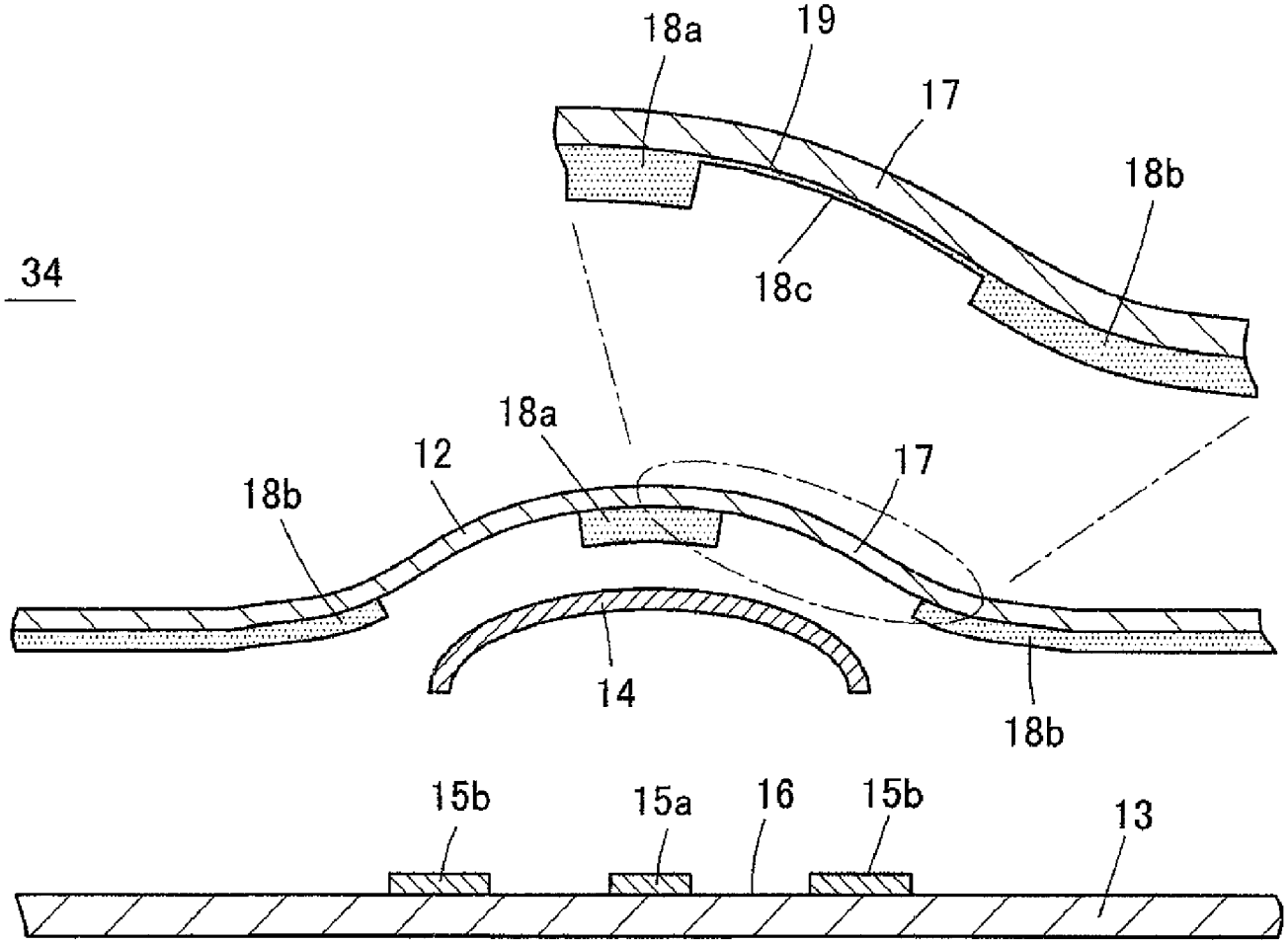
FIG. 9 is an exploded cross-sectional view showing a key switch module substrate according to a second embodiment of the present invention.

FIG. 9 is an exploded cross-sectional view showing a key switch module substrate 34 according to a second embodiment of the present invention. In the present embodiment, the thicknesses of the pressure sensitive adhesive layers of the projecting portion 18*a* and the substrate pressure sensitive adhesive layer 18*b* are differed. In particular, the thickness of the projecting portion 18*a* is desirably thicker than the thickness of the substrate pressure sensitive adhesive layer 18*b*.

As a method of differing the thickness of the projecting portion 18*a* and the thickness of the substrate pressure sensitive adhesive layer 18*b*, for example, the height of the ridge or the depth of the valley is differed between the surface for applying the projecting portion 18*a* and the surface for applying the substrate pressure sensitive adhesive layer 18*b* when forming bumps on the transfer roller 22 with the roll coater method as shown in FIGS. 4A and 4B. Furthermore, the projecting portion 18*a* may be over-applied in a silk printing method as shown in FIG. 5, or two two-sided pressure sensitive adhesive tapes may be superimposed and attached at the projecting portion 18*a* in the method of using the two-sided pressure sensitive adhesive tape as shown in FIG. 6. Any printing method may be adopted according to the method of forming the projecting portion 18*a* and the substrate pressure sensitive adhesive layer 18*b* in different steps.

When using the transfer roller 22 with bumps through the roll coater method, the pressure sensitive adhesive may also attach to the non-adhering surface 19 thereby forming a pressure sensitive adhesive layer 18*c*, as shown partially enlarged in FIG. 9. If the pressure sensitive adhesive layer does not exist at the non-adhering surface 19 as in the first embodiment, the outer peripheral portion of the apex portion of the contact spring 14 does not adhere to the fixing sheet 12 at the pressure sensitive adhesive layer, and thus the outer peripheral portion of the contact spring 14 does not stick to the fixing sheet 12 thereby inhibiting deformation, and the click feeling in time of switch operation becomes more satisfactory, and thus preferable. However, if sufficiently thin to an extent of not adhering to the contact spring 14, problems will not arise even if the pressure sensitive adhesive layer 18*c* is formed at the non-adhering surface 19.

In the key switch module substrate 34 of the second embodiment, the thickness of the projecting portion 18*a* is thicker than the thickness of the substrate pressure sensitive adhesive layer 18*b*, and thus the apex portion of the contact spring 14 is more easily pushed by the projecting portion 18*a*, and the contact spring 14 is easily made to adhere in time of assembly.

Figures 10A, 10B, 10C, 10D:
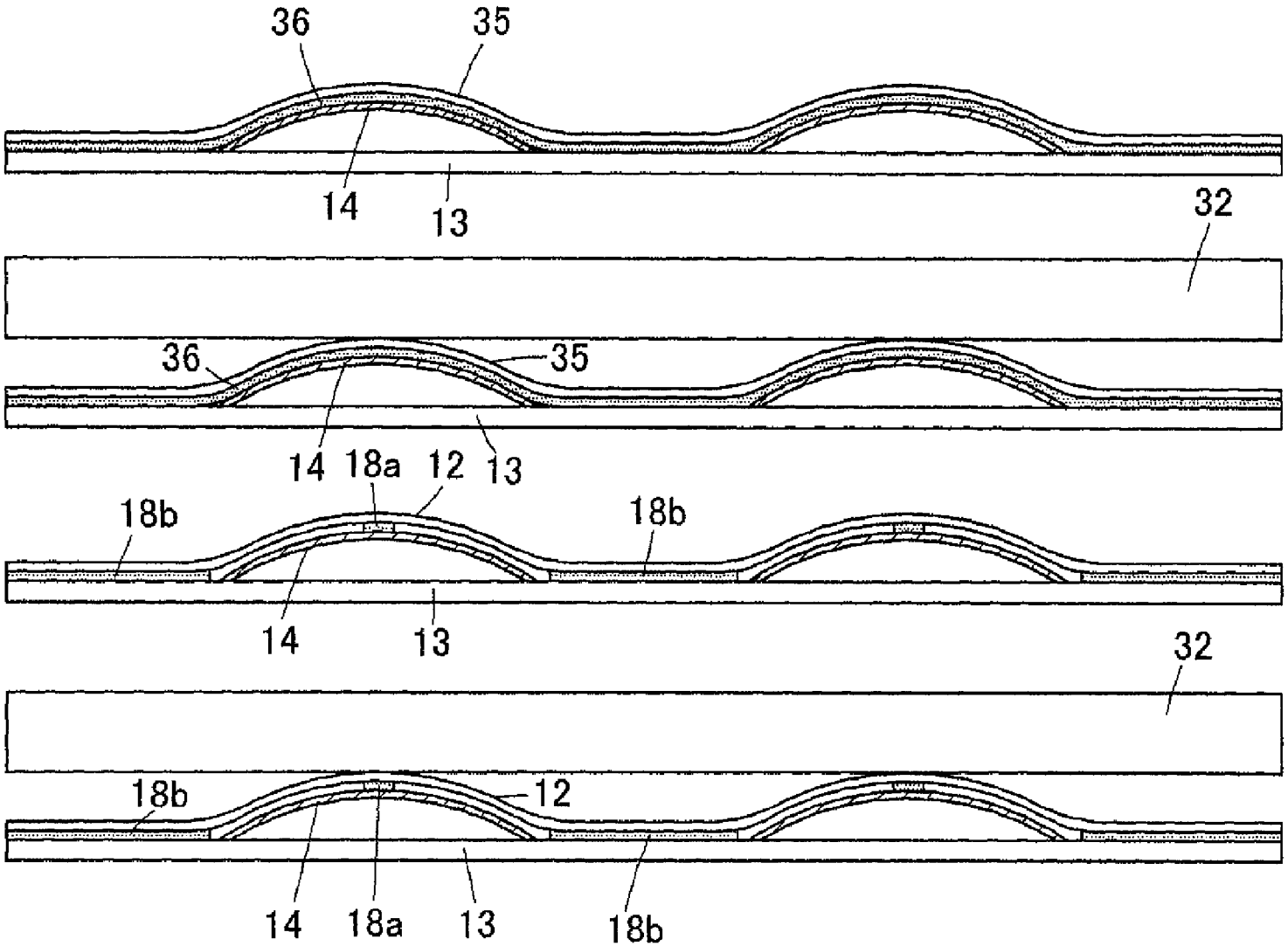
FIGS. 10A to 10D are schematic views showing samples used in measurement.

The result of measuring the click rate using the samples of the key switch module substrate 34 of the second embodiment and the comparative example (prior art example) will now be described. FIGS. 10A to 10D show the samples used in measurement. FIG. 10A is a sample of the comparative example, where a fixing sheet 35 formed with a pressure sensitive adhesive layer 36 at a thickness of 0.1 mm on the entire back surface of the base material sheet was used. The click rate was measured using the sample of FIG. 10A, and a value of 32% was obtained. FIG. 10B is a sample of the comparative example, where the light guide sheet 32 was superimposed on the front surface of the sample of FIG. 10A. The click rate was measured with the sample of FIG. 10B, and a value of 25% was obtained. FIG. 10C is a sample of the second embodiment, where the fixing sheet 12 formed with the projecting portion 18*a* having a thickness of 0.2 mm and the substrate pressure sensitive adhesive layer 18*b* having a thickness of 0.1 mm on the back surface of the base material sheet was used. The click rate was measured using the sample of FIG. 10C, and the click rate of 49% was obtained. FIG. 10D is a sample of the second embodiment, where the light guide sheet 32 was superimposed on the front surface of the sample of FIG. 10C. The click rate was measured with the sample of FIG. 10D, and a value of 45% was obtained.

Figure 11:
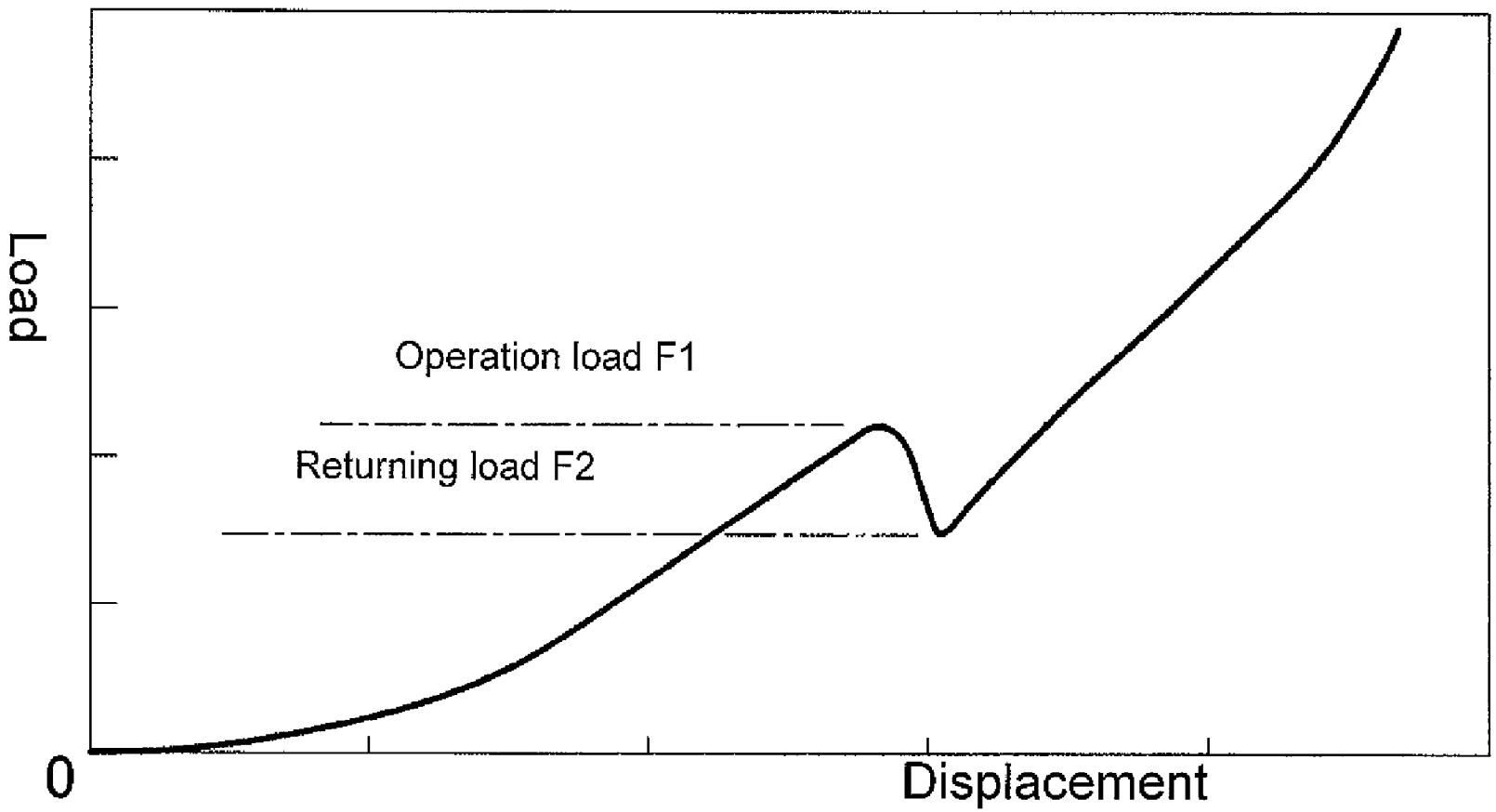
FIG. 11 is a view showing an F-S curve of the contact spring.

The click rate was measured in the following manner. A large load was gradually applied to the location immediately above the contact spring 14 in each sample, and the displacement of the apex portion of the contact spring 14 then was measured, where an F-S curve shown in FIG. 11 was obtained. When the load is gradually increased, the contact spring 14 elastically deforms and performs click operation when a certain load is reached, and thus the load at the start of the click operation (operation load) F1 was measured. When the click operation is terminated and the load is gradually decreased from the state in which the contact spring 14 is elastically deformed, the contact spring 14 elastically returns at a certain load, and thus the load at the time of elastic return (returning load) F2 was measured. The click rate is calculated from the following equation using the operation load F1 and the returning load F2 measured in such a manner.

$$\text{Click rate}[\%]=100\times(F1-F2)/F1$$

The feeling in time of clicking becomes more satisfactory the larger the value of the click rate.

The click rate (actual usage reference) at which practicality as the key switch module is accepted is slightly over 30%, and thus practicality is barely accepted at the click rate of 32% in the sample of FIG. 10A. However, in the case of the sample of FIG. 10B in which the light guide plate was superimposed, the click rate lowered to 25%, and the click feeling greatly lowered (lowering of 7%). In the sample of the second embodiment of FIG. 10C, a high value of the click rate of 49% was obtained, and a very satisfactory click feeling was obtained. In the case of the sample of FIG. 10D in which the light guide plate was superimposed, the click rate lowered only to 45% (lowering of 4%), and thus satisfactory click feeling was maintained.

The diameter of the projecting portion 18*a* and the thicknesses of the projecting portion 18*a* and the substrate pressure sensitive adhesive layer 18*b* were variously changed in the key switch module substrate 34 in the second embodiment, and the relationship between the thickness of the pressure sensitive adhesive layer and the click rate was reviewed. Tables 1 to 3 show the measurement results.

The common conditions of the samples used in the measurement are that the base material sheet 17 made from a reflecting sheet having a thickness of 38 μm and the contact spring 14 having a diameter of 4 mm are used, and the projecting portion 18*a* and the substrate pressure sensitive adhesive layer 18*b* are formed using the two-sided pressure sensitive adhesive tape. The diameter of the projecting portion 18*a*, the thickness of the projecting portion 18*a* (T1), and the thickness of the substrate pressure sensitive adhesive layer 18*b* (T2) were changed, and the click rate was measured by a load cell. The load cell used is the load cell manufactured by Aikoh Engineering Co., Ltd.

Table 1 shows a case in which the diameter of the projecting portion 18*a* is 1 mm, where the column of T1 in Table 1 shows the thickness [mm] of the projecting portion 18*a*, T2 shows the thickness [mm] of the substrate pressure sensitive adhesive layer 18*b*, and the value [%] of the click rate shows a case when the light guide sheet is not present and a case when the light guide sheet is superimposed on the front surface.

TABLE 1

(Diameter of projecting portion: 1 mm)

| Pressure sensitive adhesive layer | | Click rate (%) | |
|---|---|---|---|
| T1 [mm] | T2 [mm] | Without light guide sheet | With light guide sheet |
| 0.1 | 0.1 | 48.6 | 44.2 |
| 0.1 | 0.2 | 34.0 | 11.2 |
| 0.2 | 0.1 | 49.0 | 44.8 |
| 0.2 | 0.2 | 47.8 | 39.4 |

According to Table 1, if the thickness of the projecting portion 18*a* is thinner than the thickness of the substrate pressure sensitive adhesive layer 18*b*, the click rate is 34.0% when the light guide sheet is not present, which is a value close to the click rate (32%) of the prior art example. The click rate becomes 11.2% when the light guide sheet is superimposed, which is worse than the click rate (25%) of the prior art example. If the thickness of the projecting portion 18*a* is greater than the thickness of the substrate pressure sensitive adhesive layer 18*b*, on the other hand, the click rate is 49.0% when the light guide sheet is not present and 44.8% when the light guide sheet is superimposed, and thus highest click rate is obtained in either case. Furthermore, satisfactory click rate was obtained irrespective of the presence of the light guide sheet even if the thickness of the projecting portion 18*a* is equal to the thickness of the substrate pressure sensitive adhesive layer 18*b*.

Table 2 shows a case in which the diameter of the projecting portion 18*a* is 2 mm.

TABLE 2

(Diameter of projecting portion: 2 mm)

| Pressure sensitive adhesive layer | | Click rate (%) | |
|---|---|---|---|
| T1 [mm] | T2 [mm] | Without light guide sheet | With light guide sheet |
| 0.1 | 0.1 | 42.0 | 39.2 |
| 0.1 | 0.2 | 27.5 | 10.8 |
| 0.2 | 0.1 | 44.4 | 41.3 |
| 0.2 | 0.2 | 45.3 | 41.7 |

Comparing Table 2 and Table 1, the click rate is slightly lower when the diameter of the projecting portion 18*a* is 2 mm than when the diameter is 1 mm. This is because enhancement of the click rate of the contact spring 14 depends on how to push "only the apex portion" of the contacting spring 14. However, in the case of Table 2 as well, satisfactory click rate is obtained for when the light guide sheet is not present and for when the light guide sheet is superimposed except when the thickness of the projecting portion 18*a* is thinner than the thickness of the substrate pressure sensitive adhesive layer 18*b*.

Table 3 shows a case in which the diameter of the projecting portion 18*a* is 3 mm.

TABLE 3

| (Diameter of projecting portion: 3 mm) | | | |
|---|---|---|---|
| Pressure sensitive adhesive layer | | Click rate (%) | |
| T1 [mm] | T2 [mm] | Without light guide sheet | With light guide sheet |
| 0.1 | 0.1 | 37.5 | 26.6 |
| 0.1 | 0.2 | 21.2 | 12.3 |
| 0.2 | 0.1 | 35.2 | 27.5 |
| 0.2 | 0.2 | 28.9 | 22.8 |

According to Table 3, the click rate is greatly lowered in all cases, and thus does not have superiority compared to the prior art example. The click rate is more satisfactory than the prior art example only when the thicknesses of the projecting portion 18*a* and the substrate pressure sensitive adhesive layer 18*b* are both 0.1 mm, and the light guide sheet is present.

It is apparent that the diameter of the projecting portion 18*a* is preferably smaller than or equal to 0.5 times (=2 mm/4 mm) the diameter of the contact spring 14 from the results of Table 1 to Table 3, but the diameter of the projecting portion 18*a* is desirably as small as possible within an extent of holding the contact spring 14. The click rate lowers when the thickness of the projecting portion 18*a* is thinner than the substrate pressure sensitive adhesive layer 18*b*, and thus the thickness of the projecting portion 18*a* needs to be equal to the thickness of the substrate pressure sensitive adhesive layer 18*b*, or the thickness of the projecting portion 18*a* needs to be thicker than the thickness of the substrate pressure sensitive adhesive layer 18*b*. The thickness of the projecting portion 18*a* is preferably greater than or equal to 0.1 mm and smaller than or equal to 0.2 mm.

Third Embodiment

Figure 12:
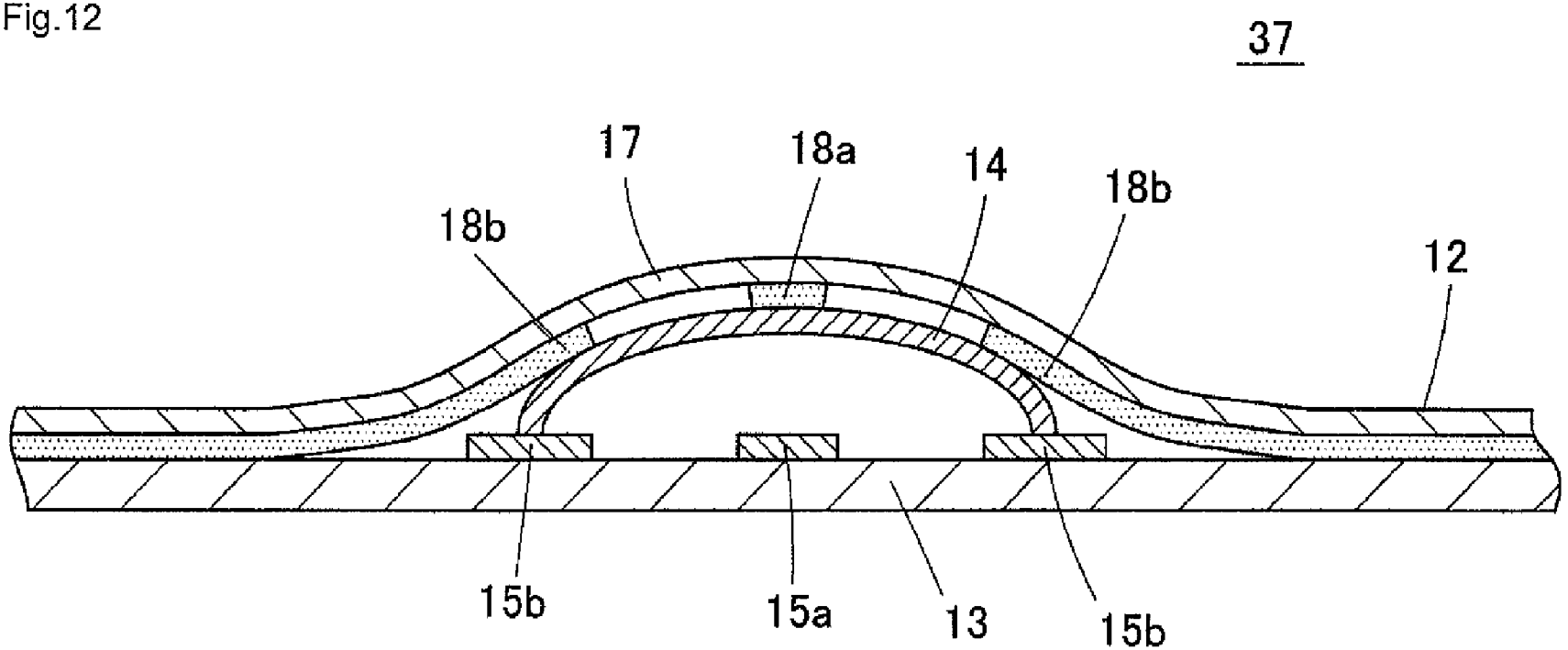
FIG. 12 is a cross-sectional view showing a key switch module substrate according to a third embodiment of the present invention.

FIG. 12 is a cross-sectional view showing a key switch module substrate 37 according to a third embodiment of the present invention. In the present embodiment, the inner diameter of the substrate pressure sensitive adhesive layer 18*b* is formed to be slightly smaller than the diameter of the contact spring 14. Therefore, the inner peripheral portion of the substrate pressure sensitive adhesive layer 18*b* adheres to the bottom portion of the outer periphery of the contact spring 14 in the key switch module substrate 37.

According to this embodiment, the contact spring 14 is less likely to shift and move when pushed down, or the contact spring 14 is less likely to rise since the inner peripheral portion of the substrate pressure sensitive adhesive layer 18*b* adhered to the printed wiring substrate 13 is made to adhere to the bottom portion of the contact spring 14.

Fourth Embodiment

Figure 13:
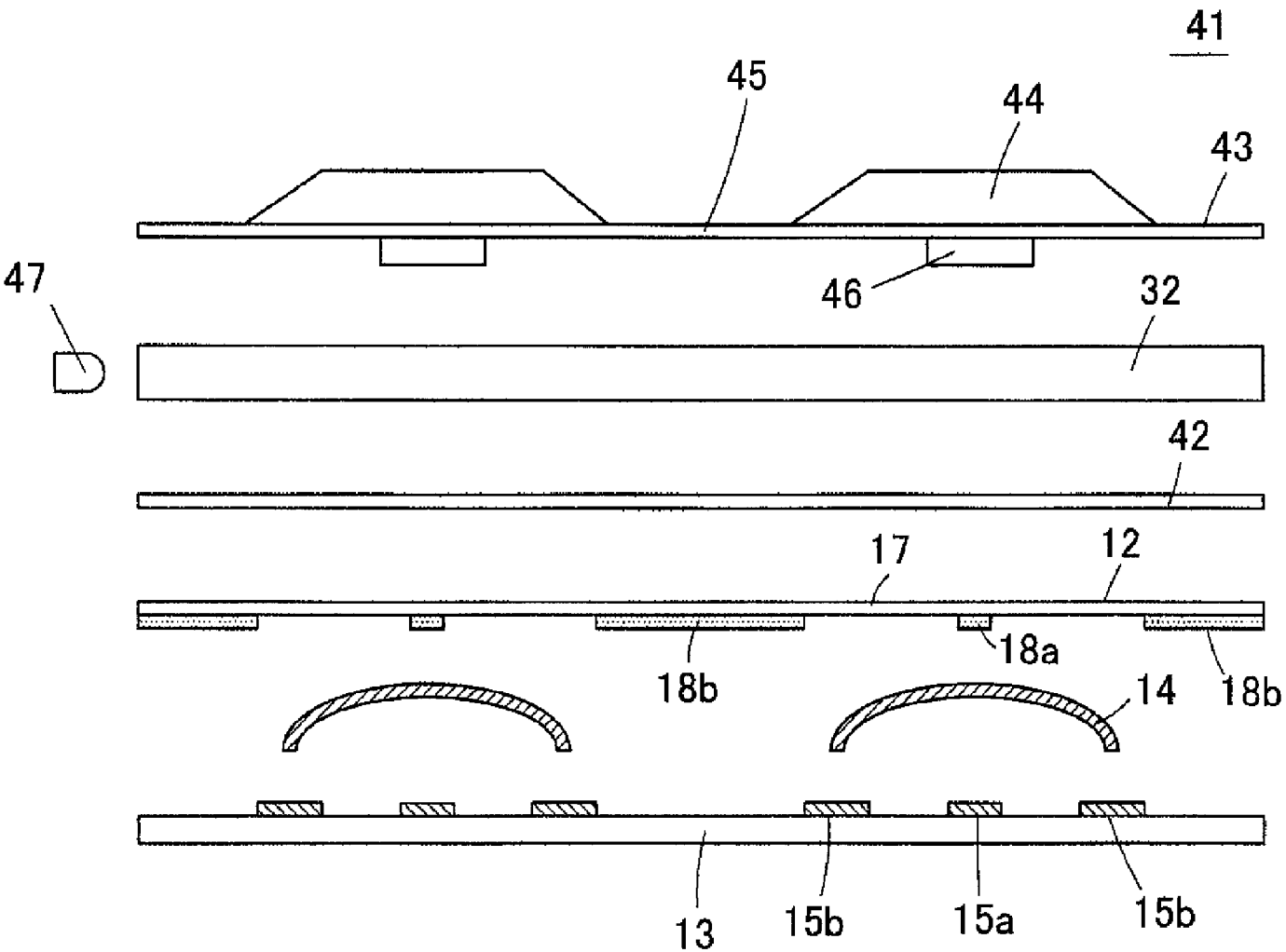
FIG. 13 is a cross-sectional view showing a configuration of a key switch module according to a fourth embodiment of the present invention.

FIG. 13 is a cross-sectional view showing a configuration of a key switch module 41 according to a fourth embodiment of the present invention. In this embodiment, the contact spring 14 and the fixing sheet 12 are superimposed on the printed wiring substrate 13 to form the key switch module substrate, where a reflecting sheet 42 and the light guide sheet 32 are superimposed thereon, and a key top 43 is further superimposed to configure a key switch module 41. The key top 43 is arrayed with keys 44 (push-button) to be pushed with a finger on the front surface of a flexible key sheet 45, and a pusher 46 of resin molded article is projected out from the back surface of the key 44. The key 44 is arranged so as to be positioned immediately above each contact spring 14. A light source 47 such as a LED is arranged facing the side surface of the light guide sheet 32. The light guide sheet 32 is formed by a transparent flexible sheet having high index of refraction, where microscopic diffusion pattern for diffusely reflecting light is formed on the back surface. The diffusion pattern is a microscopic pattern of recessed-form or projected-form such as pyramid, semispherical, or triangular prism.

When the light source 47 is caused to emit light, the light exited from the light source 47 enters the light guide sheet 32 from the opposing side surface, and is guided through the light guide sheet 32. The light guided through the light guide sheet 32 is diffusely reflected by the diffusion pattern in the middle, where one part exits from the front surface of the light guide sheet 32 thereby causing the front surface of the light guide sheet 32 to emit light. In the diffusion pattern, the number (pattern density) per unit area of the microscopic pattern of recessed-form or projected-form increases as the distance from the light source 47 becomes larger so that the entire front surface of the light guide sheet 32 is caused to emit light at substantially uniform luminance. The entire key top 43 is illuminated from the rear surface side by the light guide sheet 32, so that the key operation will not be mistaken even when used in dark places.

The reflecting sheet 42 has a function of reflecting the light leaked from the back surface of the light guide sheet 32 to re-enter the light guide sheet 32 from the back surface, thereby enhancing the usage efficiency of the light in the light guide sheet 32 and brightening the illumination.

In this case, if the area of the pusher 46 is greater than the area of the projecting portion 18*a*, the area of the pusher 46 directly contacting the light guide sheet 32 is increased, and the area of the projecting portion 18*a* not directly contacting the light guide sheet 32 but directly contacting the contact spring 14 is reduced. Thus, the pusher 46 is less likely to bend the front surface of the light guide sheet 32 and be buried in the light guide sheet 32, and furthermore, the apex portion of the contact spring 14 can be pushed with the force of pushing the key 44 concentrated at the small projecting portion 18*a*, whereby the click feeling becomes satisfactory.

Figure 14:
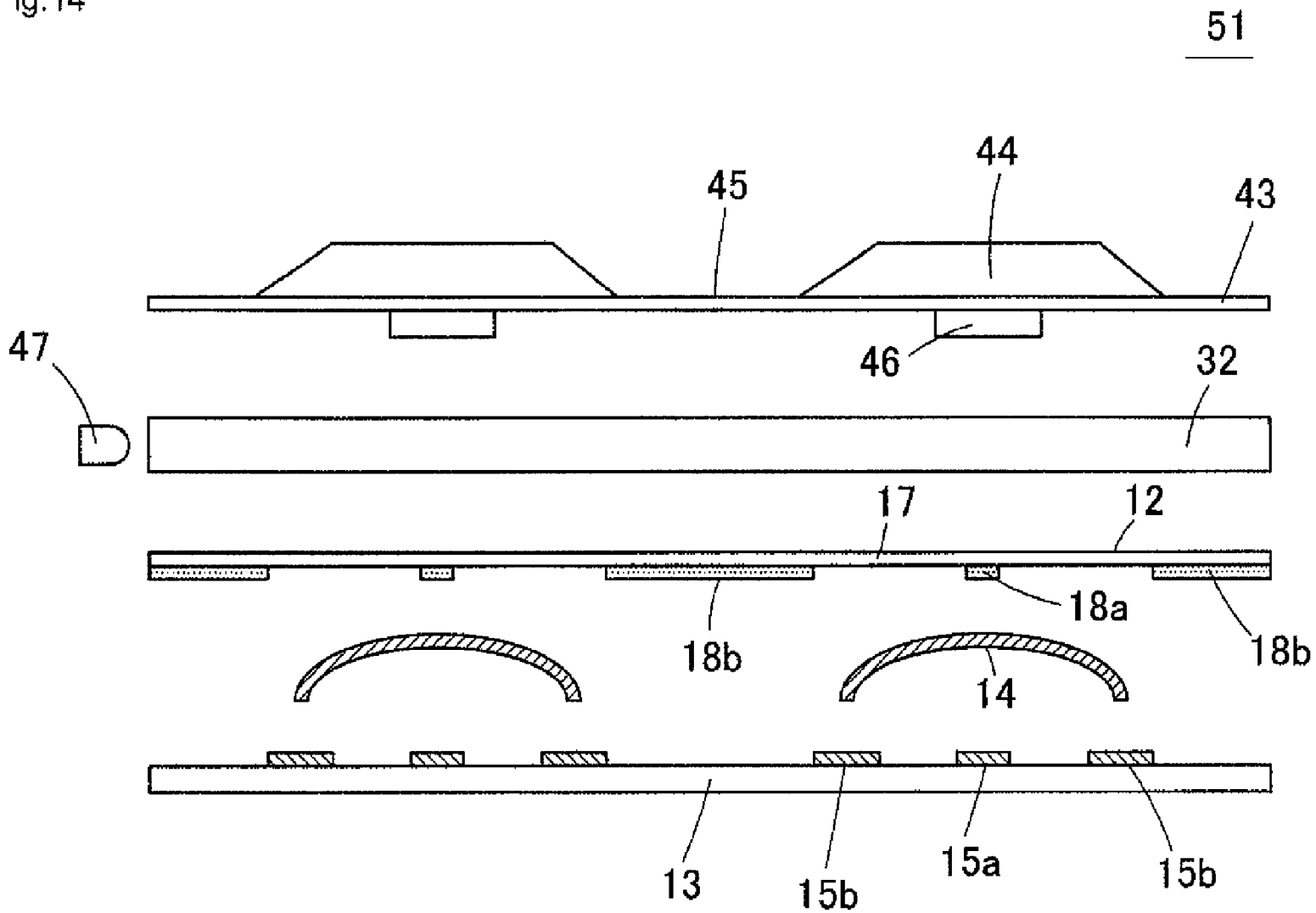
FIG. 14 is a cross-sectional view showing a variant of the fourth embodiment.

FIG. 14 is a cross-sectional view showing a variant of the fourth embodiment. In the key switch module 51, the reflecting sheet 42 is omitted from the key switch module 41 of the fourth embodiment. Thus, in the key switch module 51, the number of components can be reduced, the cost can be reduced, and the key switch module 51 can be thinned.

A reflecting sheet having a surface reflectivity of greater than or equal to 70% is used for the base material sheet 17 since the reflecting sheet 42 is omitted. The reflecting sheet may be a white sheet for diffusely reflecting the light, or may be a mirror sheet for mirror reflecting the light. The reflecting sheet of too high reflectivity leads to high cost, and thus the reflecting sheet having a reflectivity of slightly higher than 70% is desirable. Since the base material sheet 17 has high reflectivity, the light leaked from the back surface of the light guide sheet 32 is reflected by the fixing sheet 12 to re-enter the light guide sheet 32. That is, the light usage efficiency of the light guide sheet 32 does not lower even if the reflecting sheet 42 is omitted.

Figure 15:
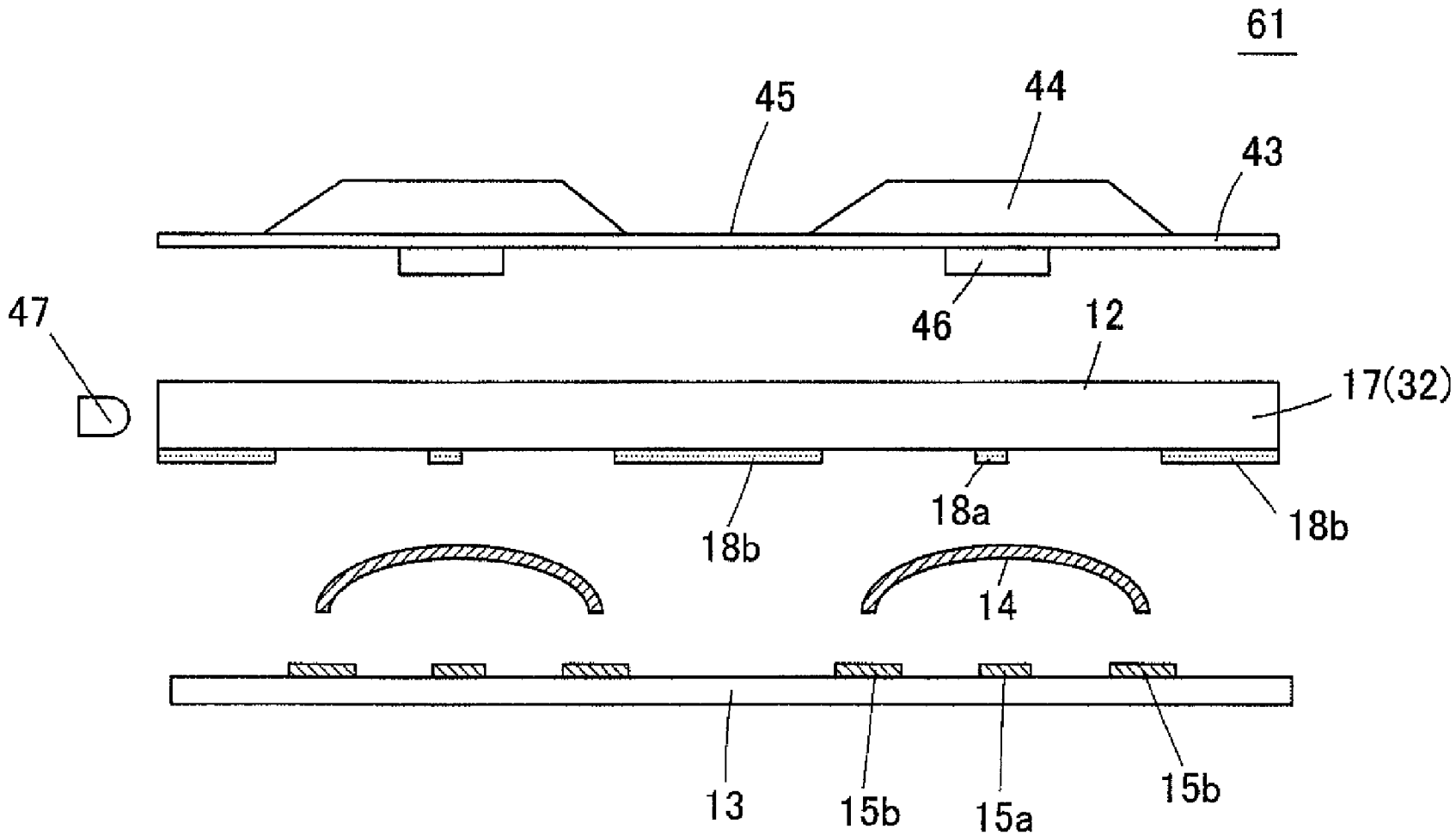
FIG. 15 is a cross-sectional view showing another variant of the fourth embodiment.

FIG. 15 is a cross-sectional view showing another variant of the fourth embodiment. In a key switch module 61, the reflecting sheet 42 and the light guide sheet 32 are omitted from the key switch module 41 of the fourth embodiment. Thus, in the key switch module 61, the number of components is further reduced, the cost is reduced, and the key switch module 51 can be further thinned.

In such key switch module 61, the light guide sheet 32 is used for the base material sheet 17 of the fixing sheet 12, and the light source 47 is arranged facing the side surface of the fixing sheet 12 (the fixing sheet 12 may be omitted, and the projecting portion 18*a* and the substrate pressure sensitive adhesive layer 18*b* may be arranged on the back surface of the light guide sheet 32). Thus, the key 44 can be illuminated from the back surface side by the base material sheet 17 in the key switch module 61.

Although not shown, a figure of the key may be drawn on the front surface of the key sheet 45 instead of arranging the key 44, as another further variant.

Fifth Embodiment

Figure 16:
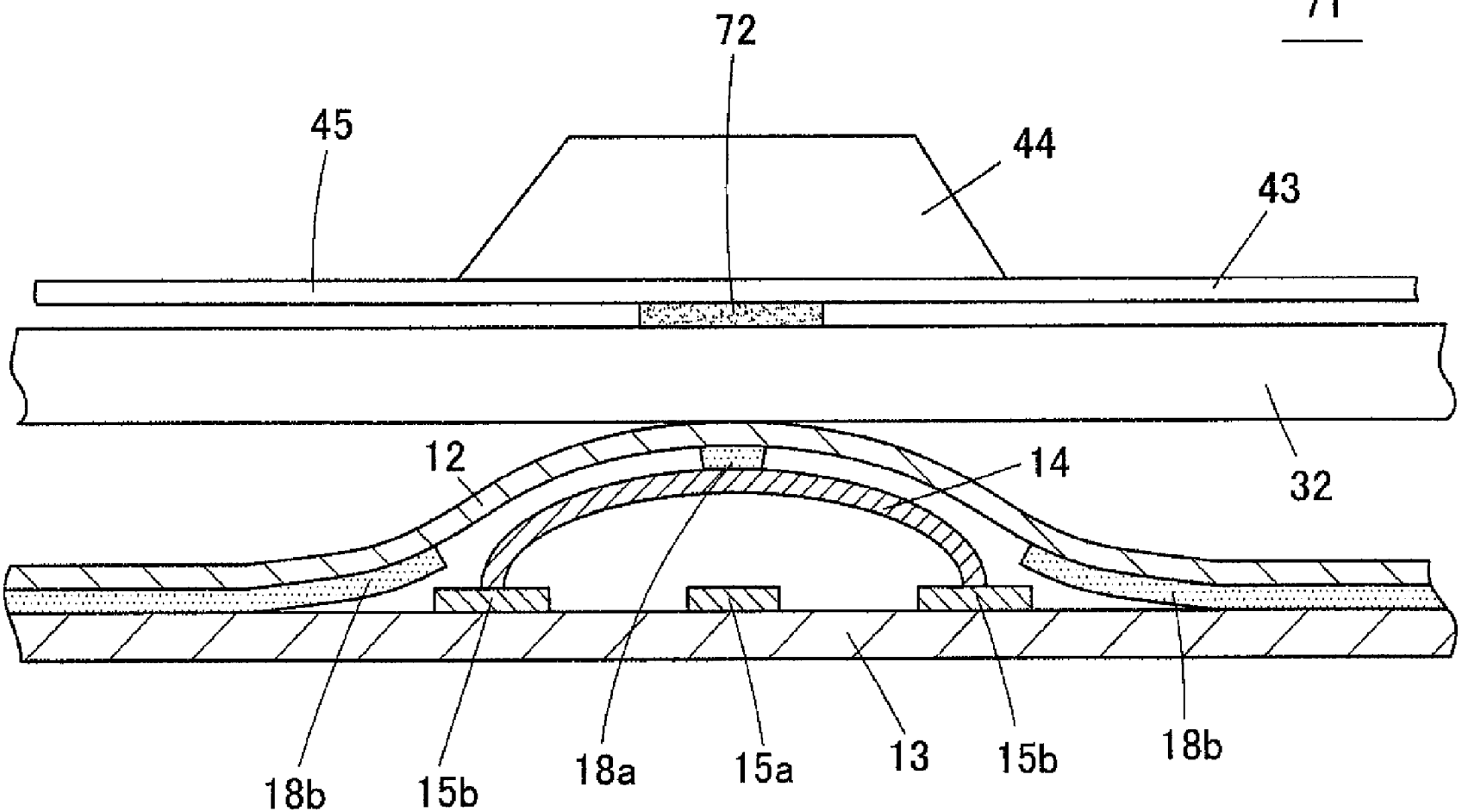
FIG. 16 is a cross-sectional view showing a key switch module according to a fifth embodiment of the present invention.
Figure 17:
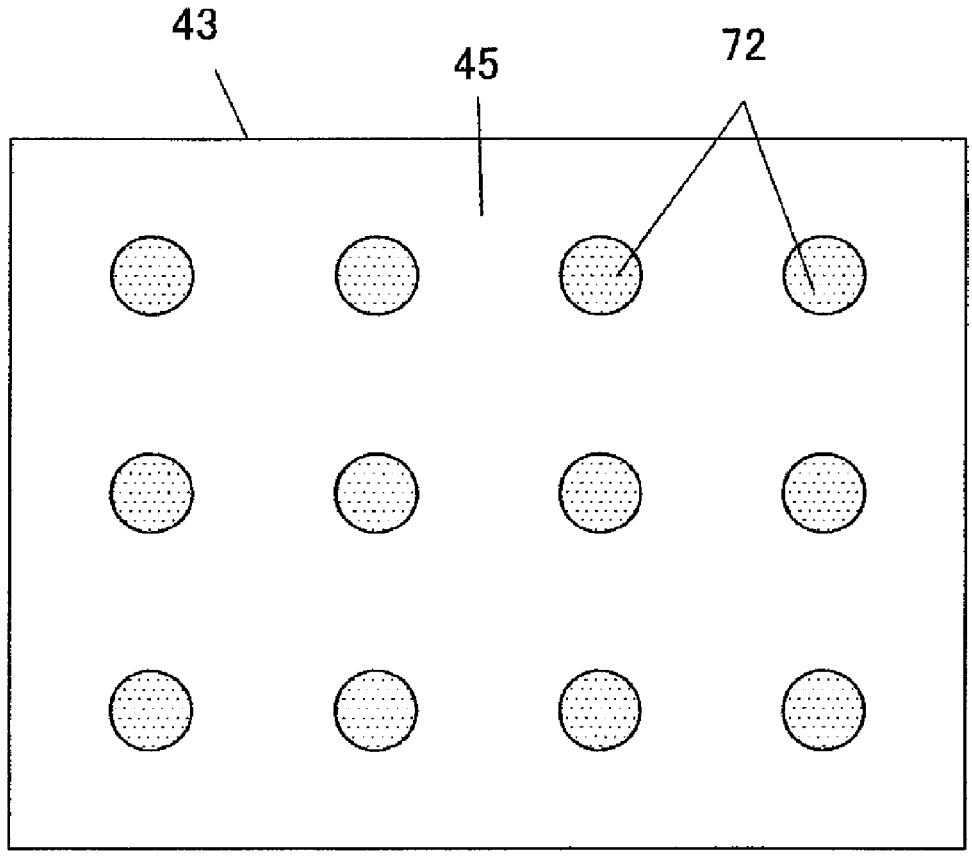
FIG. 17 is a back surface view of the key top in the fifth embodiment.

FIG. 16 is a cross-sectional view showing a key switch module 71 according to a fifth embodiment of the present invention. In the key switch module 71, a pusher 72 is formed by a pressure sensitive adhesive layer on the back surface of the key sheet 45 in correspondence to the back surface of the key 44. FIG. 17 shows the back surface of the key top 43 arrayed with a plurality of keys 44. The key top 43 is made to adhere to the light guide sheet 32 by the pusher 72 or the pressure sensitive adhesive layer, and each pusher 72 is positioned immediately above the contact spring 14. According to such a structure, thinning and lower cost of the key switch module 71 are achieved.

Figure 18:
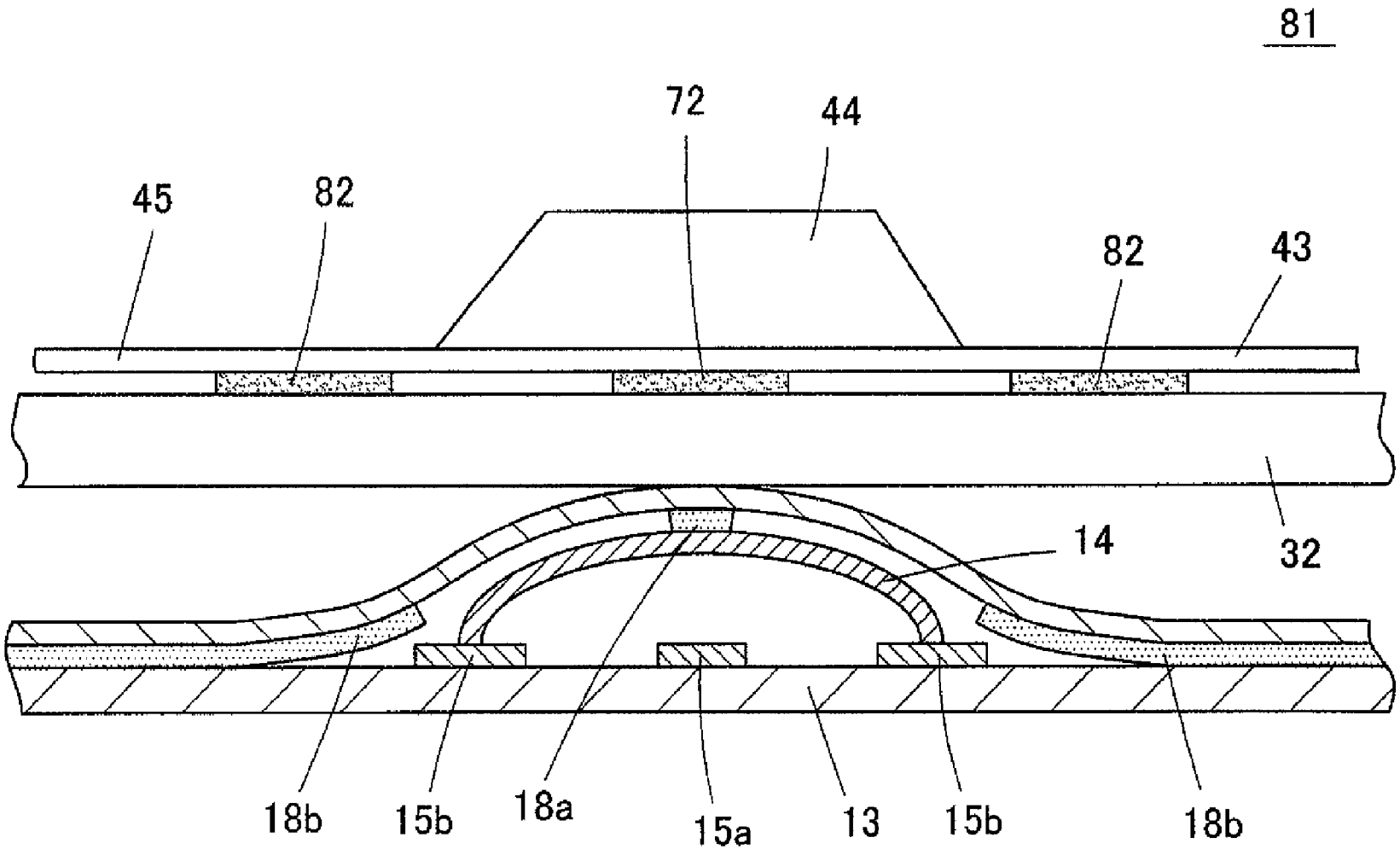
FIG. 18 is a cross-sectional view showing a key switch module according to a variant of the fifth embodiment of the present invention.
Figure 19:
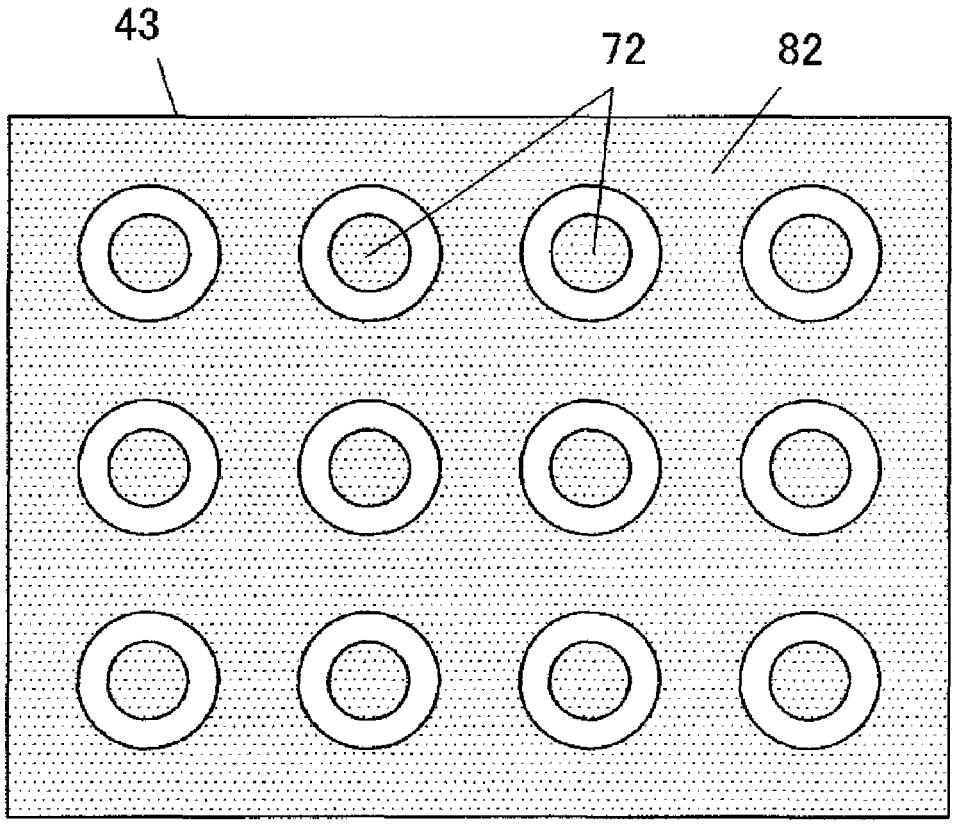
FIG. 19 is a back surface view of the key top in the variant of the fifth embodiment.

FIG. 18 is a cross-sectional view showing a key switch module 81 according to a variant of the fifth embodiment. In the variant, a pressure sensitive adhesive layer 82 is also formed at the periphery of the pusher 72 at the back surface of the key sheet 45, as shown in FIG. 19. However, a region without the pressure sensitive adhesive layer is formed between the pusher 72 and the pressure sensitive adhesive 82. In this variant, the pressure sensitive adhesive layer 82 is made to adhere to the front surface of the light guide sheet 32, and thus the key top 43 can be fixed to the light guide sheet 32 more strongly.

Other Embodiments

In each embodiment described above, the fixing sheet is made to adhere to the contact spring or the printed wiring substrate by an adhesive (pressure sensitive adhesive), but problems will not arise even if an adhesive is used instead of the pressure sensitive adhesive. For instance, ultraviolet curing adhesive may be applied to the back surface of the transparent base material sheet 17 to form the projecting portion 18*a* and the substrate pressure sensitive adhesive (adhesive layer) 18*b*, and thereafter, the substrate may be irradiated with ultraviolet ray to cure the adhesive after superimposing the contact spring and the fixing sheet 12 on the substrate. Soft adhesive is desirably used when using adhesive with respect to the flexible printed wiring substrate 13. However, manufacturing is easier if the pressure sensitive adhesive is used since the pressure sensitive adhesive does not need to be cured as with the adhesive.

What is claimed is:

1. A key switch sheet comprising:

a pressure sensitive adhesive layer for holding a contact spring by adhering to an apex portion of a dome-shaped contact spring at a back surface of a base material sheet;

wherein a thickness of the pressure sensitive adhesive layer at a region to be made to adhere to the apex portion of the contact spring is thicker than a thickness of the pressure sensitive adhesive layer at a peripheral region; and wherein the thickness of the pressure sensitive adhesive layer at a region to be made to adhere to the apex portion of the contact spring is thicker than or equal to a thickness of the pressure sensitive adhesive layer at a region where the base material sheet is made to adhere to a substrate.

2. The key switch sheet according to claim 1, wherein the apex portion of the contact spring is made to adhere to the pressure sensitive adhesive layer for holding the contact spring to hold the contact spring.

3. The key switch sheet according to claim 1, wherein the pressure sensitive adhesive layer does not exist at the peripheral region.

4. The key switch sheet according to claim 1, wherein the pressure sensitive adhesive layer formed at the back surface of the base material sheet is formed by applying a pressure sensitive adhesive to the back surface of the base material sheet using a screen printing method, a gravure printing method, or a roll coater method.

5. The key switch sheet according to claim 1, wherein the thickness of the pressure sensitive adhesive layer formed at the region to be made to adhere to the apex portion of the contact spring is at least 0.1 mm and at most 0.2 mm.

6. The key switch sheet according to claim 1, wherein a diameter of the region to be made to adhere to the apex portion of the contact spring is at most 0.5 times a diameter of the contact spring.

7. The key switch sheet according to claim 1, wherein the pressure sensitive adhesive layer thicker than the thickness of the pressure sensitive adhesive layer at the peripheral region is formed at a region further on the outer side than the peripheral region.

8. The key switch sheet according to claim 7, wherein the pressure sensitive adhesive layer formed at the back surface of the base material sheet is simultaneously formed at the back surface of the base material sheet.

9. A key switch module comprising:

the key switch module substrate according to claim 1; and a key top arranged on a front surface side of the key switch module substrate;

wherein the key top is arranged with, in correspondence to the position of the contact spring, a push-button for switch operating by pushing down the contact spring from the outside.

10. The key switch module according to claim 9, wherein a light guide sheet for illuminating the key top from a back surface side is arranged between the key top and the key switch module substrate.

11. The key switch module according to claim 9, wherein a pusher made of a pressure sensitive adhesive is arranged at a back surface of the push-button so as to project from the back surface, the pusher being made to adhere to a member facing a rear surface of the key top at a position corresponding to the apex portion of the contact spring.

12. A key switch module substrate comprising:

an apex portion of a dome-shaped contact spring that is made to adhere to a back surface of a base material sheet by a pressure sensitive adhesive or an adhesive, wherein the back surface of the base material sheet is made to adhere to a substrate formed with a first fixed contact and a second fixed contact, which are switched to a conduction state or an insulation state by the contact spring, by pressure sensitive adhesive or adhesive, wherein the contact spring is faced to the first fixed contact and the second fixed contact, wherein a thickness of the layer of the pressure sensitive adhesive or the adhesive at a region where the apex portion of the contact spring is made to adhere to the base material sheet is thicker than a thickness of the layer of the pressure sensitive adhesive or the adhesive at a peripheral region, wherein a thickness of the layer of the pressure sensitive adhesive or the adhesive at a region where the base material sheet is made to adhere to the substrate is thicker than a thickness of the layer of the pressure sensitive adhesive or the adhesive at the peripheral region, and wherein the thickness of the layer of the pressure sensitive adhesive or the adhesive at a region where the apex portion of the contact spring is made to adhere to the base material sheet is thicker than or equal to the thickness of the layer of the pressure sensitive adhesive or the adhesive at a region where the base material sheet is made to adhere to the substrate.

13. The key switch module substrate according to claim 12, wherein part of the pressure sensitive adhesive or the adhesive applied to the outer side of the peripheral region is made to adhere to an outer peripheral portion of the contact spring, and some or all of the remaining portions are made to adhere to the substrate.

14. The key switch module substrate according to claim 12, wherein a key switch sheet is fabricated in which the contact spring is fixed to the base material sheet by making the apex portion of the contact spring to adhere to the back surface of the base material sheet by the pressure sensitive adhesive or the adhesive, and a back surface of the key switch sheet is made to adhere to the substrate by the pressure sensitive adhesive or the adhesive to sandwich the contact spring between the substrate and the base material sheet.

15. The key switch module substrate according to claim 12, wherein the thickness of the pressure sensitive adhesive or the adhesive formed at the region to be made to adhere to the apex portion of the contact spring is at least 0.1 mm and at most 0.2 mm.

16. The key switch module substrate according to claim 12, wherein a diameter of the region to be made to adhere to the apex portion of the contact spring is at most 0.5 times a diameter of the contact spring.

17. A key switch sheet comprising:

a pressure sensitive adhesive layer for holding a contact spring by adhering to an apex portion of the dome-shaped contact spring at a back surface of a base material sheet;

wherein a region in which the pressure sensitive adhesive layer does not exist is formed at the periphery of the pressure sensitive adhesive layer formed at the region to be made to adhere to the apex portion of the contact spring, and the pressure sensitive adhesive layer is formed at a region further on the outer side of the region in which the pressure sensitive adhesive does not exist;

wherein the pressure sensitive adhesive layer formed at the region to be made to adhere to the apex portion of the contact spring and the pressure sensitive adhesive layer formed at the region on the outer side of the region in which the pressure sensitive adhesive layer does not exist are of same material;

wherein a thickness of the pressure sensitive adhesive layer formed at the region to be made to adhere to the apex portion of the contact spring is thicker than or equal to a thickness of the pressure sensitive adhesive layer formed at the region on the outer side of the region in which the pressure sensitive adhesive does not exist.

18. The key switch sheet according to claim 17, wherein the apex portion of the contact spring is made to adhere to the pressure sensitive adhesive layer for holding the contact spring to hold the contact spring.

19. The key switch sheet according to claim 17, wherein the thickness of the pressure sensitive adhesive layer formed at the region to be made to adhere to the apex portion of the contact spring is at least 0.1 mm and at most 0.2 mm.

20. The key switch sheet according to claim 17, wherein a diameter of the region to be made to adhere to the apex portion of the contact spring is at most 0.5 times a diameter of the contact spring.

21. The key switch sheet according to claim 17, wherein the pressure sensitive adhesive layer formed at the back surface of the base material sheet is a two-sided pressure sensitive adhesive tape having one pressure sensitive adhering surface adhered to the base material sheet.

22. The key switch sheet according to claim 17, wherein the base material sheet is a reflecting sheet having a surface reflectivity of at least 70%.

23. The key switch sheet according to claim 17, wherein the base material sheet is a light guide sheet for illuminating a key top.

* * * * *